US009790069B2

(12) United States Patent
Davis et al.

(10) Patent No.: US 9,790,069 B2
(45) Date of Patent: Oct. 17, 2017

(54) COLLISION AVOIDANCE SYSTEM FOR SCISSOR LIFT

(71) Applicant: The Boeing Company, Chicago, IL (US)

(72) Inventors: Gordon D. Davis, Marysville, WA (US); Gary M. Buckus, Bothell, WA (US); William W. Cleary, Pasadena, CA (US); Farshad Forouhar, Lake Forest Park, WA (US); Vincent E. Engdahl, Everett, WA (US); Curtis N. Sovereen, Everett, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 15/583,598

(22) Filed: May 1, 2017

(65) Prior Publication Data

US 2017/0233232 A1 Aug. 17, 2017

Related U.S. Application Data

(63) Continuation-in-part of application No. 14/312,607, filed on Jun. 23, 2014, now abandoned.

(51) Int. Cl.

| | |
|---|---|
| ***B66F 11/00*** | (2006.01) |
| ***B66F 11/04*** | (2006.01) |
| ***B66F 17/00*** | (2006.01) |

(52) U.S. Cl.

CPC ..... *B66F 11/042* (2013.01); *B66F 17/006* (2013.01)

(58) Field of Classification Search

None

See application file for complete search history.

(56) References Cited

U.S. PATENT DOCUMENTS

| | | | | |
|---|---|---|---|---|
| 3,670,849 | A * | 6/1972 | Milner, Jr. | B66F 11/046 182/19 |
| 3,871,478 | A * | 3/1975 | Bushnell, Jr. | B66F 11/04 182/148 |
| 5,379,655 | A * | 1/1995 | Yeakle | B66F 7/065 187/269 |
| 5,906,648 | A * | 5/1999 | Zoratti | B66F 17/003 340/436 |
| 6,189,473 | B1 * | 2/2001 | Appel | B05B 13/005 114/222 |

(Continued)

*Primary Examiner* — Jonathan M Dager

(74) *Attorney, Agent, or Firm* — Kunzler Law Group, PC

(57) ABSTRACT

Disclosed herein is a scissor lift comprising a passenger basket. The scissor lift also comprises a base that comprises wheels. The scissor lift further comprises a scissor extension mechanism between the passenger basket and the base. The scissor extension mechanism is configured to raise the passenger basket in a first direction relative to the base and lower the passenger basket in a second direction, opposite the first direction, relative to the base. The scissor lift additionally comprises a through-beam sensor system co-movably coupled to the scissor extension mechanism. The through-beam sensor system moves in a third direction, perpendicular to the first direction and the second direction, when the scissor extension mechanism raises the passenger basket and moves in a fourth direction, opposite the third direction, when the scissor extension mechanism lowers the passenger basket.

20 Claims, 14 Drawing Sheets

(56) References Cited

U.S. PATENT DOCUMENTS

| | | | | |
|---|---|---|---|---|
| 6,420,693 | B1 * | 7/2002 | Nakatsuji | E05F 15/431 250/221 |
| 6,991,067 | B2 * | 1/2006 | Dube | B66F 11/04 187/223 |
| 8,067,914 | B2 * | 11/2011 | Gifford | E05F 15/46 318/466 |
| 8,600,628 | B2 * | 12/2013 | Haemmerl | B66F 9/0755 701/50 |
| 9,079,756 | B2 * | 7/2015 | Beji | B66F 11/046 |
| 9,090,432 | B2 * | 7/2015 | Zuckerman | B66B 9/16 |
| 9,205,794 | B1 * | 12/2015 | Farooq | B60R 19/18 |
| 9,418,301 | B2 * | 8/2016 | Ghannam | G06K 9/00791 |
| 2004/0055805 | A1 * | 3/2004 | Lich | B60R 21/013 180/274 |
| 2004/0094077 | A1 * | 5/2004 | Stone | B66F 17/00 108/147 |
| 2005/0187712 | A1 * | 8/2005 | Callaghan | B66B 5/0031 701/301 |
| 2005/0283280 | A1 * | 12/2005 | Evans | B60J 10/00 701/1 |
| 2011/0209943 | A1 * | 9/2011 | Bowden | G01G 19/083 182/18 |
| 2012/0126000 | A1 * | 5/2012 | Kunzig | G06Q 10/087 235/385 |
| 2013/0153333 | A1 * | 6/2013 | Richards | B66F 11/044 182/18 |
| 2013/0153335 | A1 * | 6/2013 | Luminet | A42B 3/046 182/112 |
| 2014/0133944 | A1 * | 5/2014 | Pangrazio | B66F 9/0755 414/667 |

* cited by examiner

COLLISION AVOIDANCE SYSTEM FOR SCISSOR LIFT

CROSS-REFERENCE TO RELATED APPLICATION

This application is a continuation-in-part of U.S. patent application Ser. No. 14/312,607, filed Jun. 23, 2014, which is incorporated herein by reference.

FIELD

This disclosure relates generally to sensor systems, and more particularly to collision avoidance systems for scissor lifts.

BACKGROUND

Scissor lifts are often operated by lift operators, who are supported in a passenger basket of the scissor lift, into desired positions to allow the operators to accomplish a task or manage a repair on an elevated structure. For example, scissor lifts are used during the inspection, maintenance, and repair of aircraft. Operators generally drive the scissor lift into a desired position alongside a section of an aircraft (or other structure to be inspected or repaired). Once in position near the aircraft structure, the operator elevates the passenger basket to a desired height in order to perform the desired task on the structure.

However, while performing the inspection or repair on the structure, the operator may need to repeatedly adjust the vertical position of the passenger basket and/or repeatedly adjust the horizontal position of the passenger basket by driving the scissor lift to a new location near the structure. These position and location adjustments can result in the operator inadvertently maneuvering the scissor lift into contact with the structure (or into contact with another surrounding object).

Such collisions not only have the potential to cause aesthetic and structural damage to the structure, but may also damage the scissor lift itself. For example, the passenger basket of the scissor lift may collide with the wing of an aircraft, potentially causing substantial damage to the aircraft and requiring an extensive and costly repair. In another example, an object may inadvertently get caught in the scissor extension mechanism, thus damaging the obstructing object and damaging the scissor extension mechanism. Further, the operator may accidentally drive the scissor lift into contact with a structure because the operator did not know and could not see the position (i.e., direction) of the wheels upon moving the lift.

While certain conventional control systems endeavor to prevent scissor lift collisions, such systems are usually difficult to implement, difficult to use, and often cost the operator more time and money than saved.

SUMMARY

The subject matter of the present application has been developed in response to the present state of the art, and in particular, in response to shortcomings of conventional scissor lift systems. The subject matter of the present application has been developed to provide a system and method that overcome at least some of the above-discussed shortcomings of prior art techniques.

According to one embodiment, a method for avoiding collisions between a scissor lift and surrounding objects is disclosed. The method includes detecting at least one of a spatial proximity of the passenger basket with respect to the surrounding objects, an impact condition of the passenger basket with respect to the surrounding objects, an obstruction condition of the scissor extension mechanism with respect to the surrounding objects, and a wheel position of at least one of the wheels of the base. The method also includes determining a collision status based on at least one of the spatial proximity, the impact condition, the obstruction condition, and the wheel position. The method further includes activating a warning indicator when the collision status is within a predetermined warning threshold, and over-riding operator control of the scissor lift when the collision status is within a predetermined over-ride threshold.

In one implementation of the method, detecting the spatial proximity of the passenger basket with respect to the surrounding objects is based on input from a plurality of proximity sensor elements disposed on at least one face of the passenger basket. In yet some implementations, detecting the spatial proximity of the passenger basket with respect to the surrounding objects is based on input from only proximity sensor elements disposed on faces of the passenger basket approaching surrounding objects.

According to another embodiment, a controller apparatus for a scissor lift is described. The scissor lift includes a passenger basket, a scissor extension mechanism, and a base with wheels. The controller apparatus includes at least one of a sensing module, a collision module, a warning module, and an over-ride module. The sensing module includes, according to one embodiment, a basket proximity sub-module that detects a spatial proximity of the passenger basket to surrounding objects. The sensing module may further include a basket contact sub-module that detects an impact condition of the passenger basket with the surrounding objects, a scissor sub-module that detects an obstruction condition of the scissor extension mechanism with the surrounding objects, and a wheel sub-module that detects a wheel position of at least one of the wheels of the base.

The collision module determines a collision status based on the spatial proximity, the impact condition, the obstruction condition, and the wheel position detected by the sensing module. The warning module activates a warning indicator when the collision status is within a predetermined warning threshold and the over-ride module over-rides operator control of the scissor lift when the collision status is within a predetermined over-ride threshold.

In one implementation of the controller apparatus, the collision module determines the collision status based on a distance between the passenger basket and the nearest surrounding object. For example, the predetermined warning threshold may be less than about 5 feet and the warning indicators may include one or more of visible alarms and audible alarms. Further, the warning module may include multiple warning thresholds that correspond with multiple warning indicators. In one example, the collision module determines the collision status based on an actual collision. Further, in one implementation the controller apparatus further includes a display module that displays one or more of the spatial proximity, the impact condition, the obstruction condition, the wheel position, the collision status, the warning indicator, the warning threshold, and the over-ride threshold.

According to yet another embodiment, a collision avoidance system for a scissor lift is disclosed. The scissor lift includes a passenger basket, a scissor extension mechanism, and a base with wheels. The collision avoidance system includes a basket proximity sensor sub-system that has proximity sensor elements disposed on the passenger basket. The collision avoidance system also includes a basket contact sensor sub-system that has impact sensor elements disposed within padded bumpers coupled to the passenger basket.

In one implementation of the system, the proximity sensor elements are non-contact sensors, such as ultrasonic sensors. The passenger basket may include a front face, two side faces, a rear face, a top face, and a bottom face. The proximity sensor elements of the basket proximity sensor sub-system may be disposed on the front face, the two side faces, the top face, rear face, and the bottom face. In one implementation, the proximity sensor elements that are disposed on the two side faces are positioned midway between the front and rear faces. The passenger basket may further include an extendable platform that has proximity sensor elements disposed thereon.

In another implementation of the system, the padded bumpers are coupled to the passenger basket along edges of the passenger basket and the impact sensor elements are omni-directional type sensors.

In one implementation of the system, the system further includes a through-beam sensor system mounted to the scissor extension mechanism. The scissor extension mechanism has a basket-end portion and a base-end portion. The through-beam sensor system has at least one corresponding set of an emitter and a receiver, with each emitter and receiver attached to one or the other of the basket-end portion and the base-end portion. Still further, the collision avoidance system may include a wheel position transducer that is coupled to at least one of the wheels of the base.

According to yet another embodiment, a collision avoidance system for a scissor lift is disclosed. The scissor lift includes a passenger basket, a scissor extension mechanism, and a base with wheels. The collision avoidance system includes a through-beam sensor system mounted to the scissor extension mechanism. The scissor extension mechanism has a basket-end portion and a base-end portion. The through-beam sensor system has at least one corresponding set of an emitter and a receiver, with each emitter and receiver attached to one or the other of the basket-end portion and the base-end portion. Still further, the collision avoidance system may include a wheel position transducer that is coupled to at least one of the wheels of the base.

In one implementation, the at least one corresponding set of the emitter and the receiver of the through-beam sensor system utilizes infrared light. The scissor extension mechanism has exterior nodes so that the at least one corresponding set of the emitter and the receiver are moveable with the exterior nodes and move with the basket-end portion and the base-end portion of the scissor extension mechanism. In one specific implementation, the through-beam sensor system includes three corresponding sets of the emitter and the receiver that substantially form a sensor curtain.

According to yet another embodiment, a collision avoidance system for a scissor lift is disclosed. The scissor lift includes a passenger basket, a scissor extension mechanism, and a base with wheels. The collision avoidance system includes a wheel position transducer that detects a wheel position of at least one of the wheels of the base.

In one implementation, the collision avoidance system further includes a collision module that determines a collision status based on the wheel position detected by the wheel position transducer, a warning module that activates a warning indicator when the collision status is within a predetermined warning threshold, and an over-ride module that over-rides operator control of the scissor lift when the collision status is within a predetermined over-ride threshold.

Disclosed herein is a scissor lift. The scissor lift comprises a passenger basket. The scissor lift also comprises a base that comprises wheels. The scissor lift further comprises a scissor extension mechanism between the passenger basket and the base. The scissor extension mechanism is configured to raise the passenger basket in a first direction relative to the base and lower the passenger basket in a second direction, opposite the first direction, relative to the base. The scissor lift additionally comprises a through-beam sensor system co-movably coupled to the scissor extension mechanism. The through-beam sensor system moves in a third direction, perpendicular to the first direction and the second direction, when the scissor extension mechanism raises the passenger basket and moves in a fourth direction, opposite the third direction, when the scissor extension mechanism lowers the passenger basket. The preceding subject matter of this paragraph characterizes example 1 of the present disclosure.

The through-beam sensor system comprises a lower assembly constrained from movement in the first direction and the second direction relative to the base. The through-beam sensor system also comprises an upper assembly constrained from movement in the first direction and the second direction relative to the passenger basket. The through-beam sensor system further comprises the lower assembly is spaced-apart from the upper assembly. The preceding subject matter of this paragraph characterizes example 2 of the present disclosure, wherein example 2 also includes the subject matter according to example 1, above.

The lower assembly comprises one of a first emitter, configured to emit a first beam, or a first receiver. When the lower assembly comprises the first emitter, the upper assembly comprises a second receiver configured to receive the first beam from the first emitter. When the lower assembly comprises the first receiver, the upper assembly comprises a second emitter configured to emit a second beam. The first receiver is configured to receive the second beam from the second emitter. The first beam and the second beam move in the third direction when the scissor extension mechanism raises the passenger basket. The first beam and the second beam move in the fourth direction when the scissor extension mechanism lowers the passenger basket. The preceding subject matter of this paragraph characterizes example 3 of the present disclosure, wherein example 3 also includes the subject matter according to example 2, above.

The scissor extension mechanism comprises a plurality of legs pivotably coupled together at first pivot nodes and second pivot nodes. The first pivot nodes define a rearwardmost extent of the scissor extension mechanism. The second pivot nodes define a forwardmost extent of the scissor extension mechanism. The first beam and the second beam are adjacent the forwardmost extent of the scissor extension mechanism such that the forwardmost extent of the scissor extension mechanism is between the rearwardmost extent of the scissor extension mechanism and the first beam and second beam. The preceding subject matter of this paragraph characterizes example 4 of the present disclosure, wherein example 4 also includes the subject matter according to example 3, above.

The rearwardmost extent of the scissor extension mechanism is constrained from movement in the third direction and the fourth direction. The forwardmost extent of the scissor extension mechanism moves in the third direction when the scissor extension mechanism raises the passenger basket and moves in the fourth direction when the scissor extension mechanism lowers the passenger basket. The preceding subject matter of this paragraph characterizes example 5 of the present disclosure, wherein example 5 also includes the subject matter according to example 4, above.

Each of the first receiver and the second receiver comprises a sensor enclosed within a shield comprising a slit. The first beam is sensed by the sensor of the first receiver after passing through the slit of the shield of the first receiver. The second beam is sensed by the sensor of the second receiver after passing through the slit of the shield of the second receiver. The preceding subject matter of this paragraph characterizes example 6 of the present disclosure, wherein example 6 also includes the subject matter according to any one of examples 3-5, above.

The lower assembly comprises both the first emitter and the first receiver, and the upper assembly comprises both the second emitter and the second receiver. The preceding subject matter of this paragraph characterizes example 7 of the present disclosure, wherein example 7 also includes the subject matter according to any one of examples 3-5, above.

The lower assembly further comprises one of another first receiver, wherein the first emitter is between the first receivers, or another first emitter, wherein the first receiver is between the first emitters. When the lower assembly comprises another first receiver, the upper assembly further comprises another second emitter, wherein the second receiver is between the second emitters. When the lower assembly comprises another first emitter, the upper assembly further comprises another second receiver, wherein the second emitter is between the second receivers. The preceding subject matter of this paragraph characterizes example 8 of the present disclosure, wherein example 8 also includes the subject matter according to example 7, above.

The base of the scissor lift comprises at least one lower rail parallel to the third direction and the fourth direction. The lower assembly further comprises a lower platform to which the one of the first emitter or the first receiver is mounted. The lower assembly additionally comprises at least one first engagement element mounted to the lower platform and movably engageable with the at least one lower rail. The preceding subject matter of this paragraph characterizes example 9 of the present disclosure, wherein example 9 also includes the subject matter according to any one of examples 3-8, above.

The engagement element comprises a sled that is slidably engageable with the at least one lower rail. The preceding subject matter of this paragraph characterizes example 10 of the present disclosure, wherein example 10 also includes the subject matter according to example 9, above.

The basket of the scissor lift comprises at least one upper rail parallel to the third direction and the fourth direction. The upper assembly further comprises an upper platform to which the one of the second emitter or the second receiver is mounted. The upper assembly additionally comprises at least one second engagement element mounted to the upper platform and movably engageable with the at least one upper rail. The preceding subject matter of this paragraph characterizes example 11 of the present disclosure, wherein example 11 also includes the subject matter according to any one of examples 3-10, above.

The second engagement element comprises at least one caster. The preceding subject matter of this paragraph characterizes example 12 of the present disclosure, wherein example 12 also includes the subject matter according to example 11, above.

Also disclosed herein is a scissor lift comprising a passenger basket. The passenger basket comprises a rail. The passenger basket also comprises at least one padded bumper coupled to the rail. The padded bumper comprises a foam core made of a soft, pliable foam and at least one impact sensor element. The at least one impact sensor element comprises an array of impact sensors, embedded within the foam core. The scissor lift also comprises a base, comprising wheels. The scissor lift further comprises a scissor extension mechanism between the passenger basket and the base, the scissor extension mechanism being configured to raise and lower the passenger basket relative to the base. The preceding subject matter of this paragraph characterizes example 13 of the present disclosure.

The padded bumper comprises a weatherproof cover enveloping the foam core. The preceding subject matter of this paragraph characterizes example 14 of the present disclosure, wherein example 14 also includes the subject matter according to example 13, above.

The foam core has a thickness of at least four inches. The preceding subject matter of this paragraph characterizes example 15 of the present disclosure, wherein example 15 also includes the subject matter according to any one of examples 13 or 14, above.

The rail extends about an entire upper periphery of the passenger basket. The padded bumper extends about only a portion of the upper periphery of the passenger basket such that the passenger basket comprises a non-padded portion along the upper periphery of the passenger basket. The preceding subject matter of this paragraph characterizes example 16 of the present disclosure, wherein example 16 also includes the subject matter according to any one of examples 13-15, above.

The at least one impact sensor element extends lengthwise along an entire length of the padded bumper. The preceding subject matter of this paragraph characterizes example 17 of the present disclosure, wherein example 17 also includes the subject matter according to any one of examples 13-16, above.

The padded bumper comprises at least two impact sensor elements embedded within the foam core. The at least two impact sensor elements face orthogonal directions relative to each other. The preceding subject matter of this paragraph characterizes example 18 of the present disclosure, wherein example 18 also includes the subject matter according to any one of examples 13-17, above.

The scissor lift further comprises at least two padded bumpers. The at least two padded bumpers are lengthwise orthogonal to each other. The at least one impact sensor elements of the at least two padded bumpers are lengthwise orthogonal to each other. The preceding subject matter of this paragraph characterizes example 19 of the present disclosure, wherein example 19 also includes the subject matter according to any one of examples 13-18, above.

The padded bumper is configured to prevent damage to a part impacted by the padded bumper. The preceding subject matter of this paragraph characterizes example 20 of the present disclosure, wherein example 20 also includes the subject matter according to any one of examples 13-19, above.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter, they are not therefore to be considered to be limiting of its scope. The subject matter will be described and explained with additional specificity and detail through the use of the drawings, in which.

DETAILED DESCRIPTION

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

Figure 1:
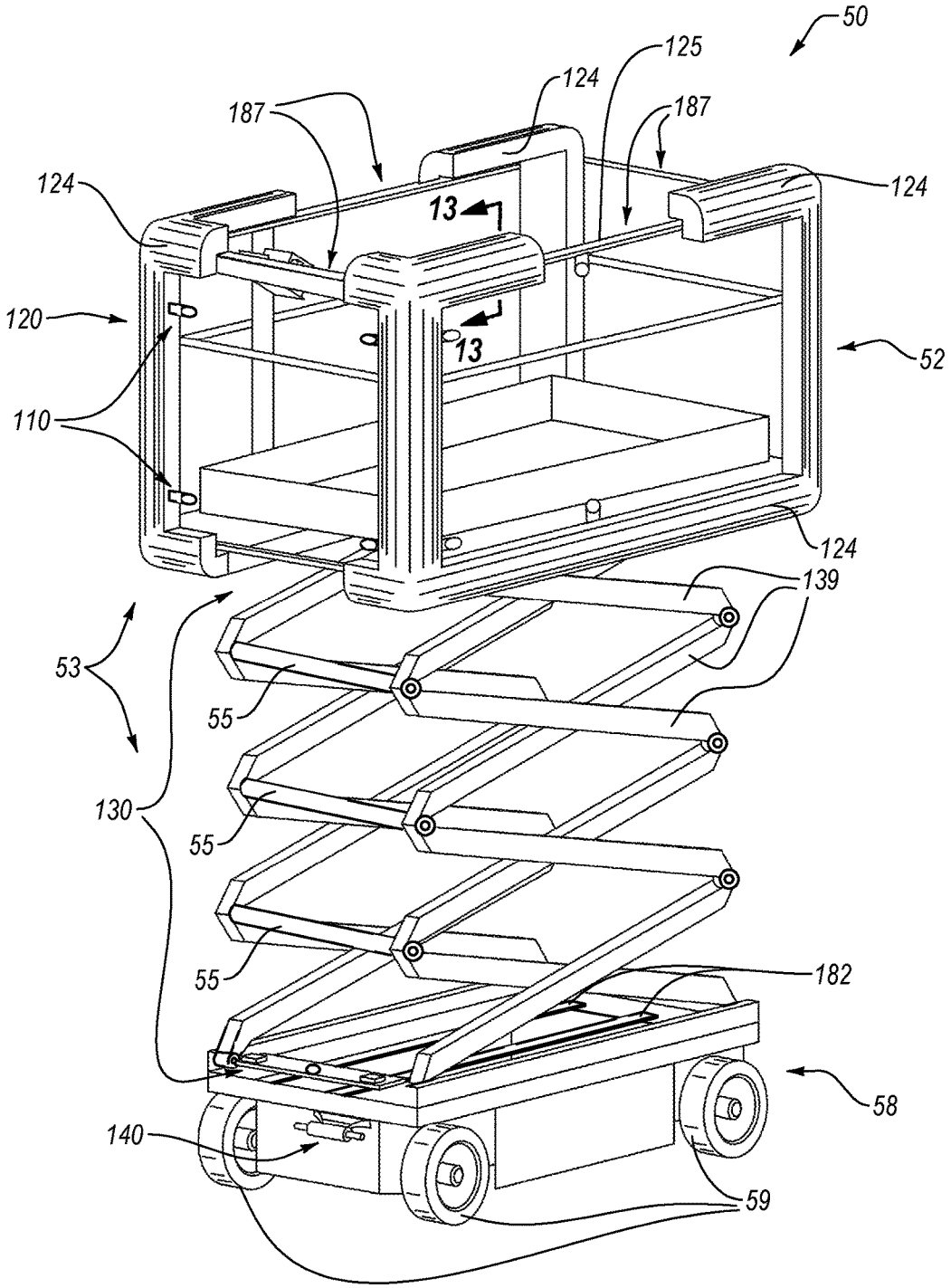
FIG. 1 is a perspective view of a scissor lift having a collision avoidance system, according to one or more examples of the present disclosure.

FIG. 1 is a perspective view of a scissor lift 50 showing one embodiment of a collision avoidance system 53. The scissor lift 50 includes a passenger basket 52 for holding and supporting passengers, operators, and equipment. The passenger basket 52 may be configured and sized according to the specifics of a given application. According to one embodiment, the passenger basket 52 is a rectangular box that has six faces: a front face, two side faces, a rear face, a top face, and a bottom face. The faces of the passenger basket 52 in the illustrated embodiment may be formed by intersecting bars and supports, and may not be a solid planar piece of material. In other embodiments, the faces of the passenger basket 52 may be solid panels of plastic, metal, wood, etc. The passenger basket 52 also includes a user control interface, enabling one or more operators/passengers to control the operation of the scissor lift. The user control interface may include buttons, switches, levers, joysticks, a steering wheel, a throttle, a touchscreen, a keypad, a keyboard, number-pads, etc.

The scissor lift 50 further includes a scissor extension mechanism 54. The scissor extension mechanism 54 includes a plurality support members 139 (e.g., legs) hingedly coupled together in a pantographic structure. The pantographic structure allows the interconnected support members 139 to extend and retract, thus permitting a user to correspondingly raise and lower the passenger basket 52.

Figure 4:
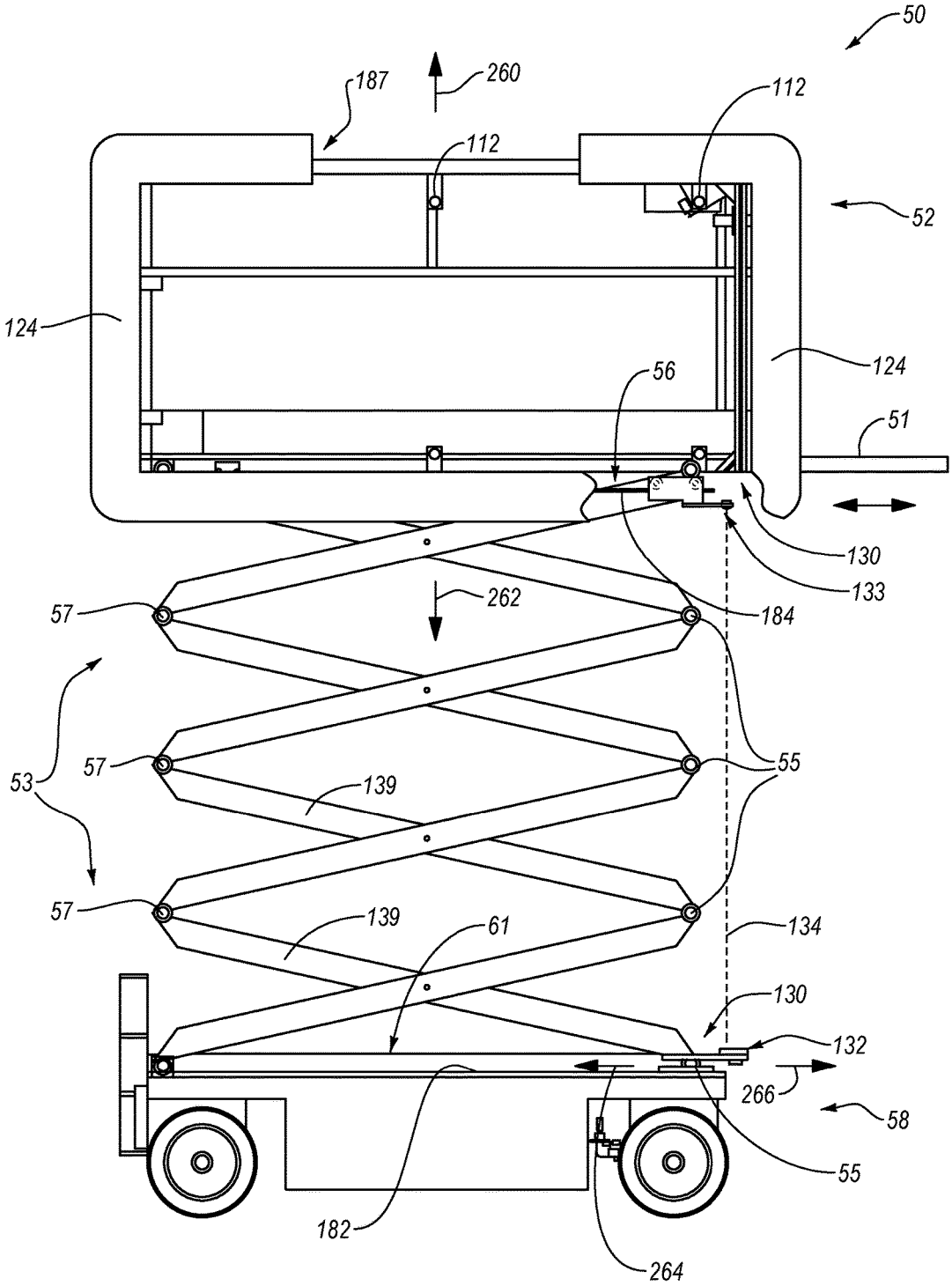
FIG. 4 is a side view of a scissor lift with a collision avoidance system, specifically showing additional details of a through-beam sensor sub-system, according to one or more examples of the present disclosure.
Figure 8:
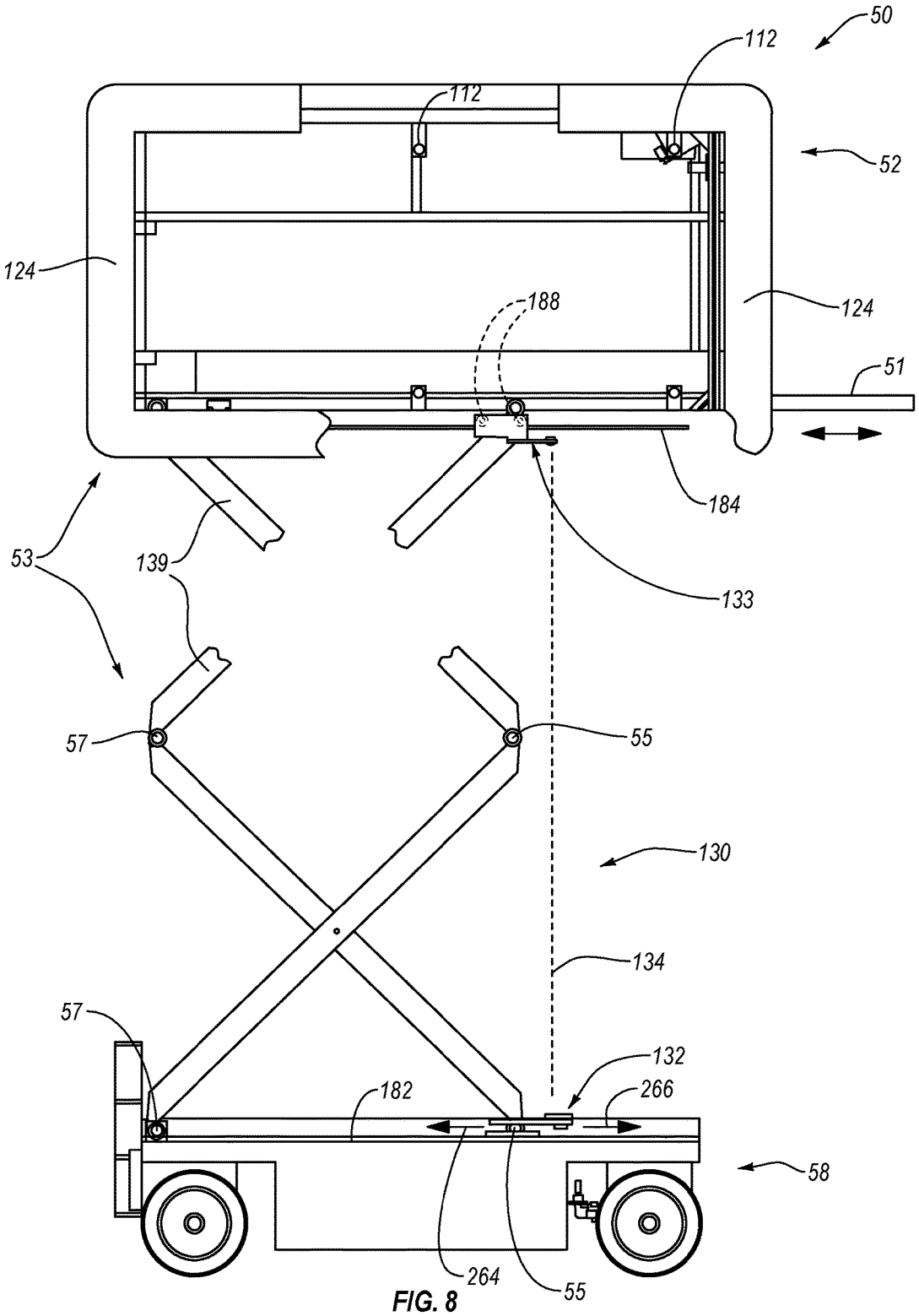
FIG. 8 is a side view of the scissor lift of FIG. 4 shown with a passenger basked raised to an intermediate position above the base of the scissor lift, according to one or more examples of the present disclosure.
Figure 9:
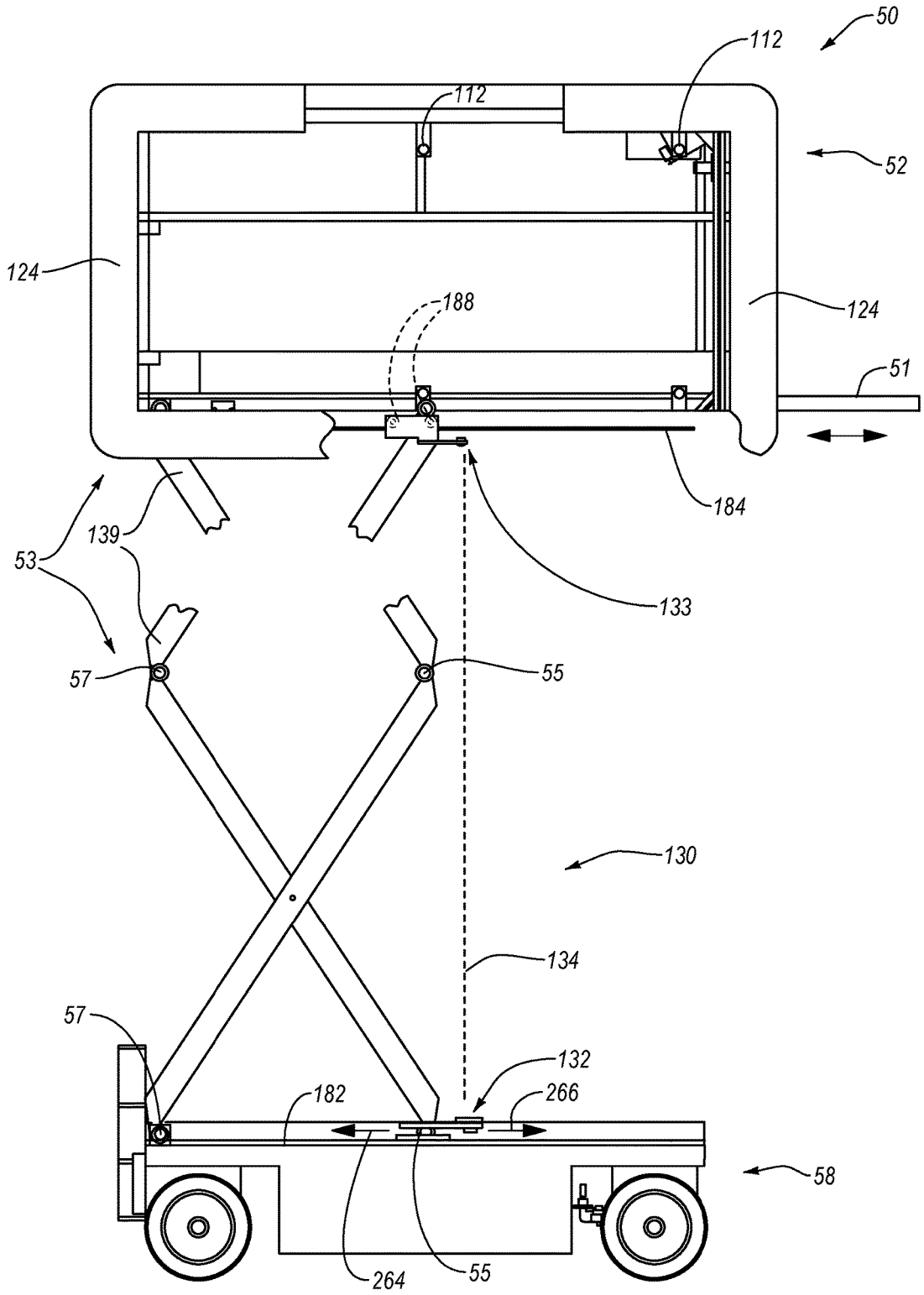
FIG. 9 is a side view of the scissor lift of FIG. 4 shown with a passenger basked raised to fully-raised position above the base of the scissor lift, according to one or more examples of the present disclosure.

For example, as shown in FIGS. 4, 8, and 9, the passenger basket 52 is shown being raised in the first direction 260 relative to the base 58 or lowered in the second direction 262 relative to the base 58.

Figure 2:
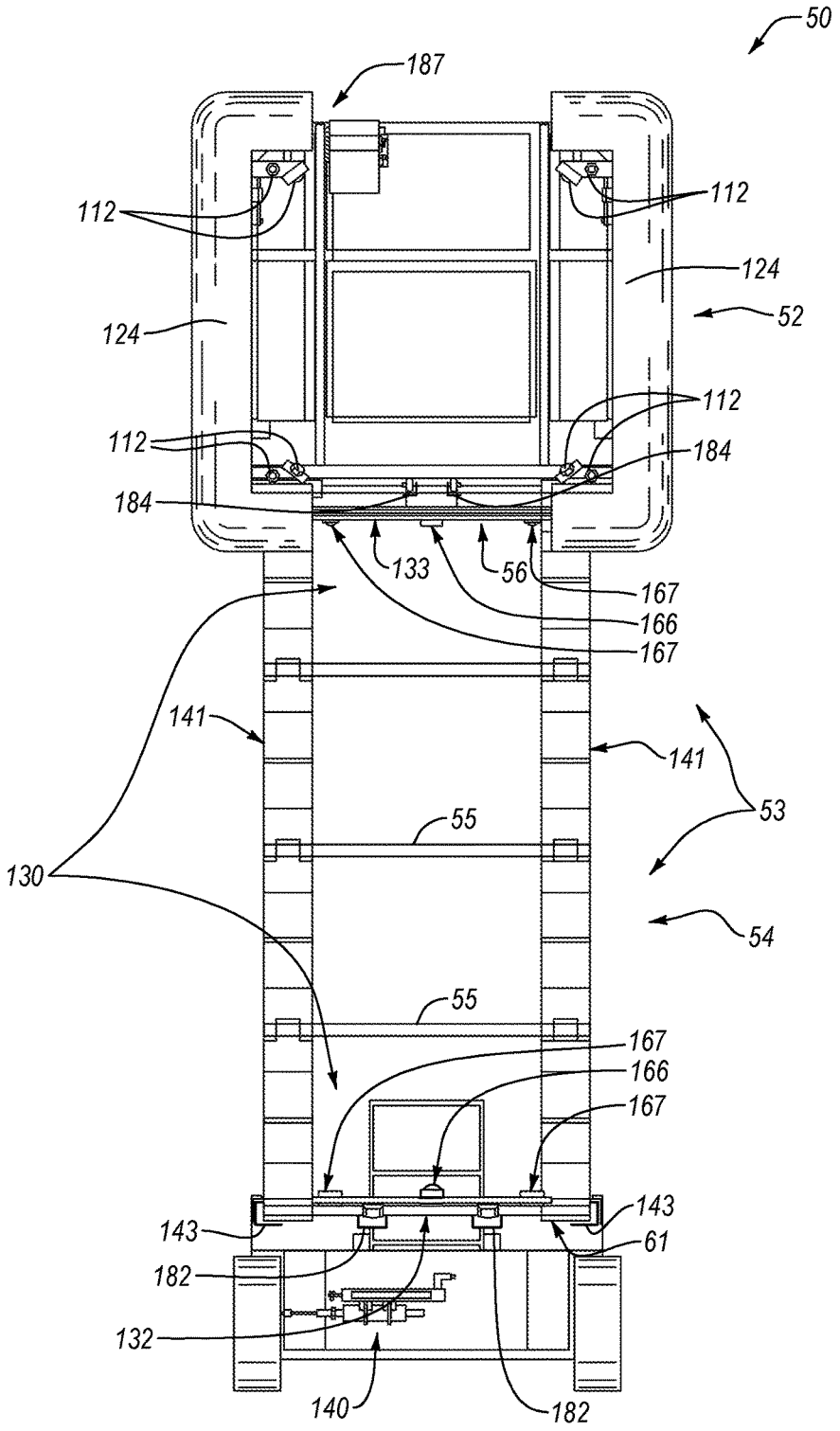
FIG. 2 is a front view of a scissor lift showing a collision avoidance system generally, and specifically showing details of a basket proximity sensor sub-system and a basket contact sensor sub-system, according to one or more examples of the present disclosure.
Figure 3:
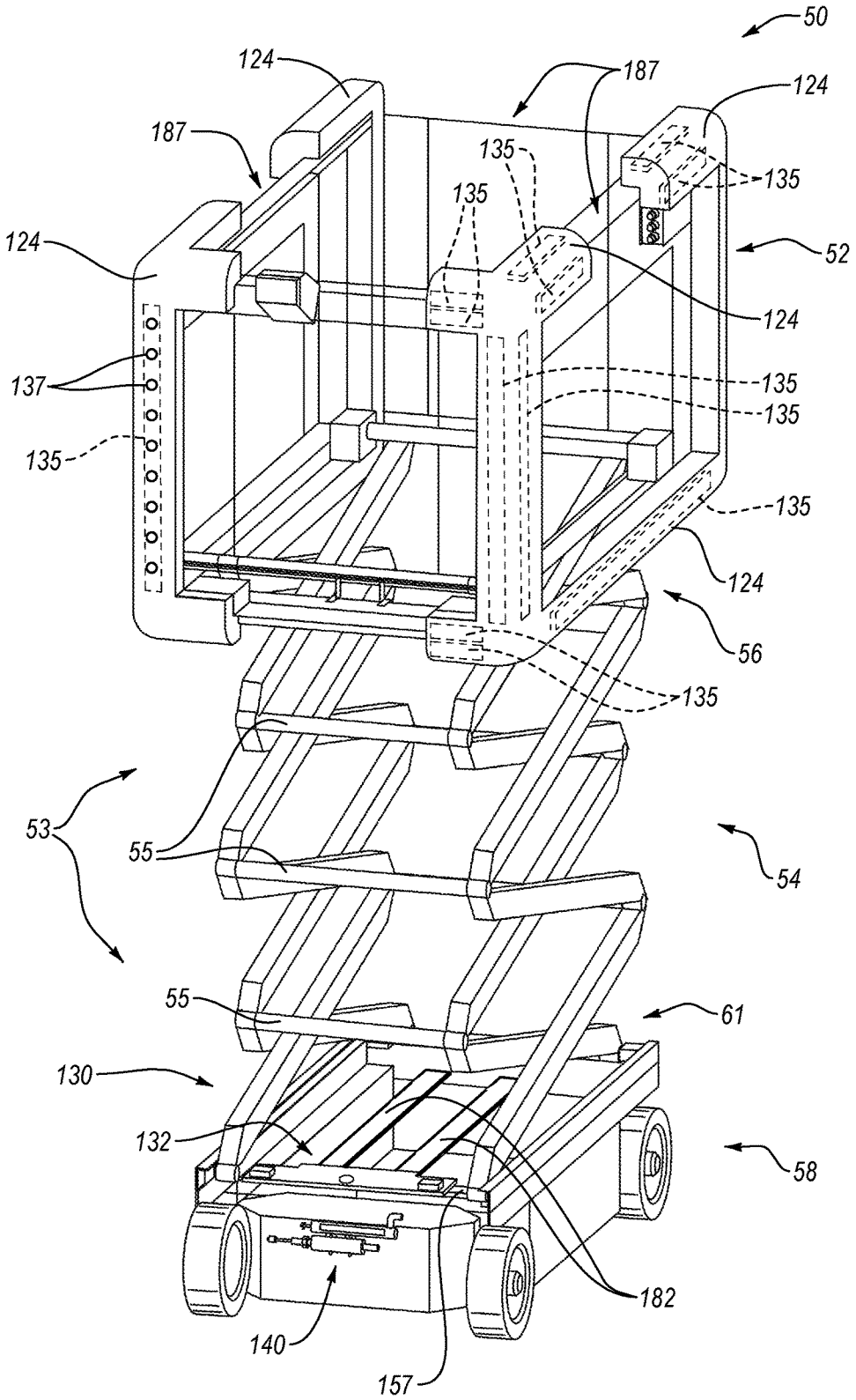
FIG. 3 is a front perspective view of a scissor lift with a collision avoidance system, specifically showing details of a through-beam sensor sub-system, according to one or more examples of the present disclosure.

In one embodiment, as depicted, the scissor extension mechanism 54 includes two spaced apart and parallel pantographic structures 141 each with a plurality of support members 139. However, the scissor extension mechanism 54 of the scissor lift 50 may be employed with a single pantograph structure. In yet another embodiment, the scissor extension mechanism 54 may have three or more pantographic structures, according to the specifics of a given application. Also, as seen in FIGS. 2 and 3, the scissor extension mechanism 54 may have lateral supports 55, 57 or rods that extend laterally between ends of interconnected support members 139 of the pantographic structures 141 to maintain inter-alignment of the structures. The ends of the support members 139 rotate or pivot about the lateral supports 55, 57 as the scissor extension mechanism 54 raises or lowers the passenger basket 52.

The scissor lift 50 further includes a base 58 with wheels 59. The base 58 may house the power supply for operating the lift. For example, the base 58 may house an engine or an electrical energy source, such as a battery assembly or system of capacitors, for powering the lift 50. In another embodiment, the base 58 may include a hydraulic or pneumatic sub-system for driving the lift 50, and extending and retracting the scissor extension mechanism 54. For example, in one implementation, a driving mechanisms, such as a motor, may be coupled to the lowest lateral support 57 and drive the lowest lateral support 57 along rails 143 (see, e.g., FIG. 2) via rollers or sliders coupled to the lowest lateral support 57 and positioned to move along the rails 143. As described above, these power systems may be controlled and managed from a user control interface in the passenger basket. Alternatively or additionally, the scissor lift 50 may include a user control interface at the base 58 to allow the scissor lift 50 to be controlled from the ground. Although not described herein, other details and embodiments relating to a scissor lift 50, as recognized by those of ordinary skill in the art, fall within the scope of the present disclosure.

The collision avoidance system 53, according to one embodiment, includes a basket proximity sensor sub-system 110, a basket contact sensor sub-system 120, a through-beam sensor sub-system 130, and a wheel position transducer 140. Each of the control systems are described in greater detail below with reference to the remaining figures. Although the remaining figures generally depict and include all of the sub-systems 110, 120, 130, and wheel position transducer 140, it is expected that less than all of the sub-systems 110, 120, 130, 140 may be implemented in one embodiment, according to the specifics of a given application. For example, in one embodiment the basket proximity sensor sub-system 110 and the basket contact sensor sub-system may be implemented on a lift while the other sub-systems 130, 140 may be left off. In another embodiment, the basket proximity sensor sub-system 110 may be implemented as a stand-alone collision avoidance system. In other words, the implementation details and the inclusion of the sub-systems 110, 120, 130, 140 may be application specific and it is expected that those with ordinary skill in the art will recognize that these implementation variations fall within the scope of the present disclosure.

FIG. 2 is a front view of a scissor lift 50 showing one embodiment of a collision avoidance system 53, and specifically showing details of a basket proximity sensor sub-system 110 and a basket contact sensor sub-system 120. The proximity sensor sub-system 110 includes multiple proximity sensor elements 112. The proximity sensor elements 112 detect the distance between a surrounding object (i.e., a structure, an aircraft section, etc.) and the passenger basket 52. The proximity sensor elements 112, according to one embodiment, are non-contact sensor elements, such as ultrasonic sensors. Ultrasonic sensors, for example, emit an ultrasonic sound wave and receive reflected sound waves, and calculate the time for the sound wave to reflect back to the sensor, thereby determining the distance between a surrounding object and the passenger basket 52.

The proximity sensor elements 112 are disposed on the faces and/or edges of the passenger basket 52. As depicted in FIG. 2, the front face of the passenger basket 52 has multiple proximity sensor elements 112 mounted thereto. The number, spatial configuration, direction, and pattern of the proximity sensor elements 112 may be selected according to a specific application. For example, the front face of the passenger basket 52 may have comparatively more proximity sensor elements 112 (e.g., eight) than other faces of the passenger basket 52. In one embodiment, each and every face of the passenger basket 52 does not have proximity sensor elements 112. For example, the rear face of the passenger basket 52 may not need sensor elements 112 (or may only need one or two) because the scissor lift is not expected to back-up (i.e., move in reverse). Additional details relating to the use and control of the basket proximity sensor sub-system 110 are included below with reference to FIGS. 6A-7.

Figure 13:
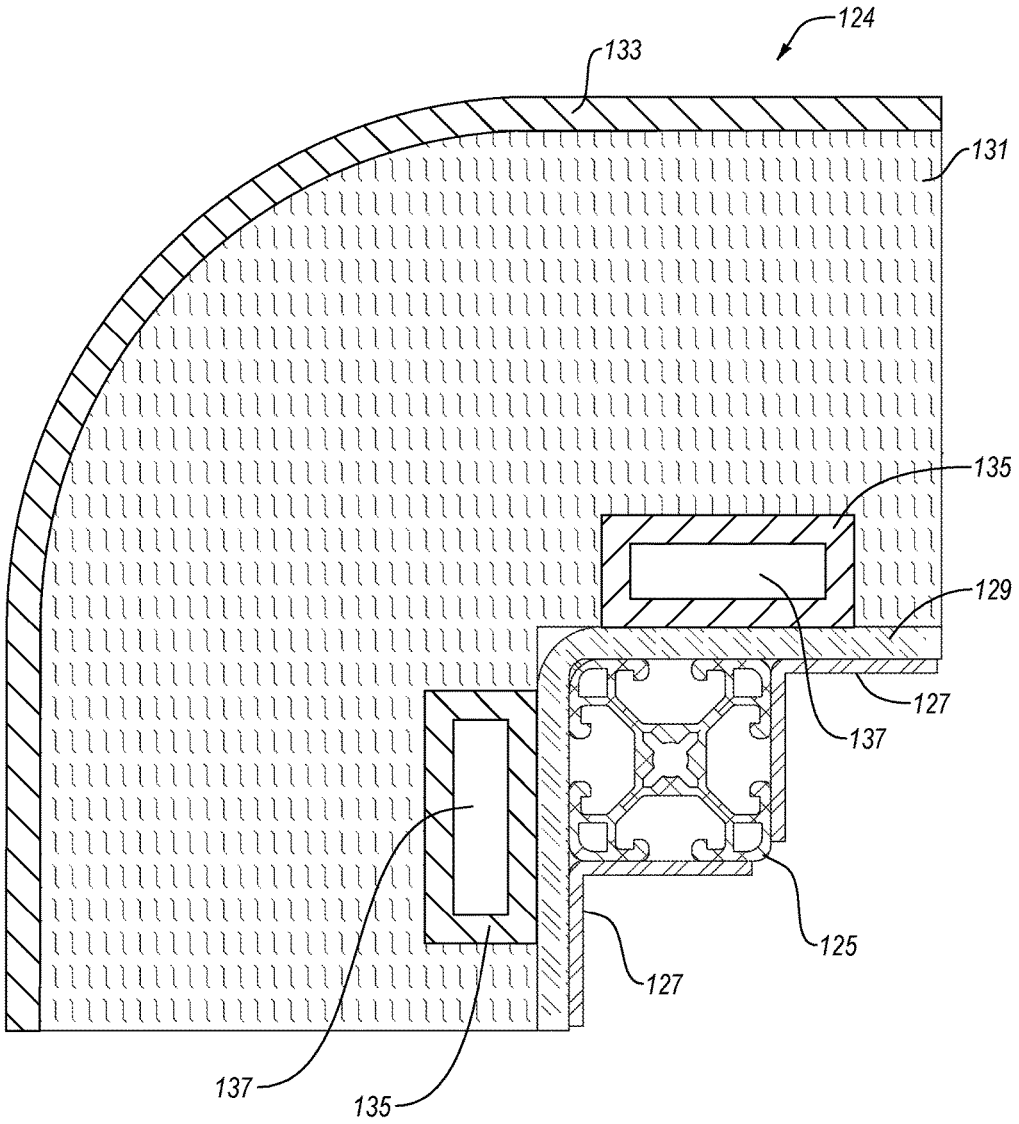
FIG. 13 is a cross-sectional side view of a padded bumper of the passenger basket of FIG. 1, taken along the line 13-13 of FIG. 1, according to one or more examples of the present disclosure

The basket impact sensor sub-system 120 includes padded bumpers 124 and impact sensor elements 135 embedded within the padded bumpers 124. The padded bumpers 124 may be constructed of various materials and may have a cushioning/foam layer and/or a protective layer that prevents, or at least mitigates, the damage that would result if a collision were to occur. Referring to FIG. 13, in one embodiment, the padded bumpers 124 each have a foam core 131 enveloped by a cover 133 (e.g., a weatherproof cover). The cover 133 is a thin layer compared to the foam core 131. The foam core 131 of the padded bumpers 124 is made of a softer foam compared to hard foam for pipe insulation. For example, the foam has a lower density compared to the foam of hard foam for pipe insulation. The softer, lower density foam of the padded bumpers promotes the sensitivity of the embedded impact sensor elements 135, while still helping to prevent damage to structures inadvertently impacted by the padded bumpers 124. The foam of the foam core 131 is pliable, squishy, and resilient in some implementations. In other words, the foam of the foam core 131 is not rigid in such implementations. In fact, hard insulating foam is not included in the padded bumpers 124. In one particular implementation, the foam of the foam core 131 of the padded bumpers 124 is a type of memory foam with a density like mattress memory foam. The cover 133 is made of a water-resistant or water-proof material, such as synthetic leather and the like.

According to one embodiment, the foam core 131 of the padded bumpers is thicker than the hard foam on pipes for insulation. For example, in one embodiment, the foam core 131 has a thickness of at least four inches, whereas the hard foam on pipes is one inch or less thick. According to certain implementations, the foam core 131 has a thickness of at least 6 inches, 8 inches, or 12 inches. In this manner, the foam core 131 of the padded bumpers is thicker and softer than conventional scissor lifts.

The padded bumpers 124 may be replaceable and/or easily mountable to the passenger basket 52. In one embodiment, the padded bumpers 124 may be coupled to the edges and railings of the passenger basket 52 while in other embodiments the padded bumpers 124 may be coupled to the face(s) of the passenger basket 52. Referring to FIGS. 1 and 13, in one embodiment, the padded bumpers 124 are coupled to a rail 125 of the framing of the passenger basket 52. More specifically, the padded bumpers 124 include a first bracket 129 to which the foam core 131 is attached (e.g., bonded, adhered, etc.). The rail 125 includes an upper rail portion defining an upper periphery or edge of the passenger basket 52, a lower rail portion defining a lower periphery or edge of the passenger basket 52, and side rail portions extending orthogonally between the upper rail portion and the lower rail portion. The first bracket 129 can form a desired angle, such as a 90-degree angle. The first bracket 129 may abut against the rail 125 and form a tight fit with the rail 125. The first bracket 129 is secured to the rail 125 by two second brackets 127 in some implementations. Each of the second brackets 127 is fixed to the rail 125 along a first side and fixed to the first bracket 129 along a second side. Although not shown, the second brackets 127 can be fixed to the rail 125 and the first bracket 129 via fasteners or other attachment methods.

As shown in FIG. 13, the embedded impact sensor elements 135 are embedded within the foam core 131 between the first bracket 129 and the cover 133. In one implementation, at least one of the padded bumpers 124 includes two, or more, embedded impact sensor elements 135 arranged to face directions orthogonal to each other. However, in some implementations, at least one of the padded bumpers 124 includes only one embedded impact sensor element 135. Each of the embedded impact sensor elements 135 is attached to a different one of two orthogonal sides of the first bracket 129. The embedded impact sensor elements 135 can be attached to the first bracket 129 with fasteners or other attachment methods. Referring to FIGS. 3 and 13, each embedded impact sensor element 135 includes an array of impact sensors 137 electrically coupled together and configured to sense impacts to the padded bumpers 124 via deformation of the foam core 131 caused by the impacts. The impact sensors 137 are spaced apart along a length of the embedded impact sensor element 135. Each impact sensor 137 can be any of various inertial sensors, such as accelerometers or vibration sensors. In some embodiments, each embedded impact sensor element 135 includes a substrate to which the impact sensors 137 are secured and a protective outer coating, such as a rubber coating, applied over the substrate and impact sensors 137. In certain implementations, each embedded impact sensor element 135 resembles an elongate stick or rod-like element having a length much greater than a width or height.

Referring to FIG. 3, in some embodiments, each padded bumper 124 includes at least one embedded impact sensor element 135 extending an entire length of the padded bumper 124. In other words, each of the padded bumpers 124 along top edges of the passenger basket 52, bottom edges of the passenger basket 52, and side edges (corners) of the passenger basket 52 includes at least one embedded impact sensor element 135 oriented lengthwise parallel to a length of the padded bumpers 124. Accordingly, the passenger basket 52 includes embedded impact sensor elements 135 that are lengthwise orthogonal to other embedded impact sensor elements 135. For example, as shown in FIG. 3, some embedded impact sensor elements 135, such as those embedded in vertical padded bumpers 124 along the vertical sides of the passenger basket 52, are lengthwise parallel to the vertical direction, and some embedded impact sensor elements 135, such as those embedded in horizontal padded bumpers 124 along the horizontal top and bottom edges of the passenger basket 52, are lengthwise parallel to the horizontal direction. In this manner, all of the padded bumpers 124 of the passenger basket 52 include embedded impact sensor elements 135 and thus are capable of detecting impacts to the padded bumpers 124.

In some embodiments, the padded bumpers 124 do not cover every portion of the upper edges of the passenger basket 52. In other words, the passenger basket 52 includes non-padded portions 187 along the upper edge or rail 125 of the passenger basket 52 where the upper edges of the passenger basket 52 are exposed. The non-padded portions 187 of the passenger basket 52 allow an operator to lean onto or over the exposed upper edges of the passenger basket 52 without setting of the impact sensor elements embedded in the padded bumpers 124. Additionally, the non-padded portions 187 of the passenger basket 52 provide a location to support parts and hardware without setting of the impact sensor elements embedded in the padded bumpers 124. The non-padded portions 187 of the passenger basket 52 are located at the center sections of the upper edges between corners of the passenger basket 52. Accordingly, in some implementations, the non-padded portions 187 are located at center sections of the upper edges of the sidewalls and/or endwalls of the passenger basket 52 between corners. To promote prevention of damage to other structures, the upper and lower corners of the passenger basket 52 are not non-padded portions 187.

The impact sensor elements, according to one embodiment, are omni-directional sensors that not only detect the occurrence of an impact/collision, but also may provide information regarding the directional force of the impact. In such an embodiment, an operator, upon being alerted about a collision, may be able to prevent further damage to the impacted object/structure by knowing the direction that he/she needs to move the scissor lift 50 to pull back from the impacted object. In other words, the basket impact sensor sub-system 120 functions as a fail-safe/last resort in the collision avoidance system 53. For example, the padded bumpers 124 mitigate collision damage and the embedded contact sensor elements alert the operator of the collision. Once again, additional details relating to the use and control of the basket contact sensor sub-system 120 are included below with reference to FIGS. 6A-7.

FIG. 3 is a front perspective view of the scissor lift 50 showing one embodiment of the collision avoidance system 53, and specifically showing details of the through-beam sensor sub-system 130. The proximity sensor elements 112 of the basket proximity sensor sub-system 110 are not depicted in FIG. 3. As stated previously, while the various sub-systems may be implemented individually or in various combinations, it is expected that, at least in one particularly useful embodiment, all of the collision avoidance sub-systems are implemented at the same time on the same scissor lift 50.

The through-beam sensor sub-system 130 includes a lower assembly 132 and an upper assembly 133. The lower assembly 132 and the upper assembly 133 are co-movably coupled with the scissor extension mechanism 54. More specifically, as the passenger basket 52 is raised by the scissor extension mechanism 54, the lower assembly 132 and the upper assembly 133 move in the third direction 264, which is perpendicular to the first direction 260 (e.g., the direction of the passenger basket 52 when raised). Similarly, as the passenger basket 52 is lowered by the scissor extension mechanism 54, the lower assembly 132 and the upper assembly 133 move in the fourth direction 266 (e.g., the direction of the passenger basket 52 when lowered). The lower assembly 132 and the upper assembly 133 remain spaced apart and vertically aligned as they move in the third direction 264 and the fourth direction 266. Moreover, the lower assembly 132 is constrained from movement in the first direction 260 and the second direction 262 relative to the base 58 and the upper assembly 133 is constrained from movement in the first direction 260 and the second direction 262 relative to the passenger basket 52.

Generally, the through-beam sensor sub-system 130 is configured to monitor and detect the presence of obstructions interfering with (i.e., contacting or impacting) or potentially interfering with the scissor extension mechanism 54 of the scissor lift 50. The lower assembly 132 includes a lower platform 160 or shelf and the upper assembly 133 includes an upper platform 190 or shelf. Mounted to the lower platform 160 is at least one emitter 167 and/or at least one receiver 166. Similarly, mounted to the upper platform 190 is at least one receiver 166 and/or at least one emitter 167. The emitter(s) 167 and/or receiver(s) 166 of the lower assembly 132 are paired with corresponding receiver(s) 166 and/or emitter(s) 167 of the upper assembly 132. More specifically, an emitter 167 mounted on the lower platform 160 is paired with a receiver 166 mounted on the upper platform 190 or a receiver 166 mounted on the lower platform 160 is paired with an emitter 167 mounted on the upper platform 190. Paired emitters 167 and receivers 166 are vertically aligned and maintain vertical alignment as the lower assembly 132 and the upper assembly 133 move in the third direction 264 and the fourth direction 266.

Each emitter 167 includes a photoeye that generates and emits a substantially continuous beam 134 (e.g., ultrasonic beam, light beam, infrared beam, laser beam, etc.) that is received by the receiver 166 paired with the emitter 167 (see, e.g., FIGS. 4, 8, and 9). If an object interrupts the continuous beam (e.g., through-beam) maintained between a paired emitter 167 and receiver 166, the sensor sub-system would detect the obstruction and issue an alert/alarm and halt the scissor lift 50 from future movement in the direction of imminent impact. Once again, additional details regarding the method, control, and alerts of the sub-systems are included below with reference to FIGS. 6A-7.

Figure 10:
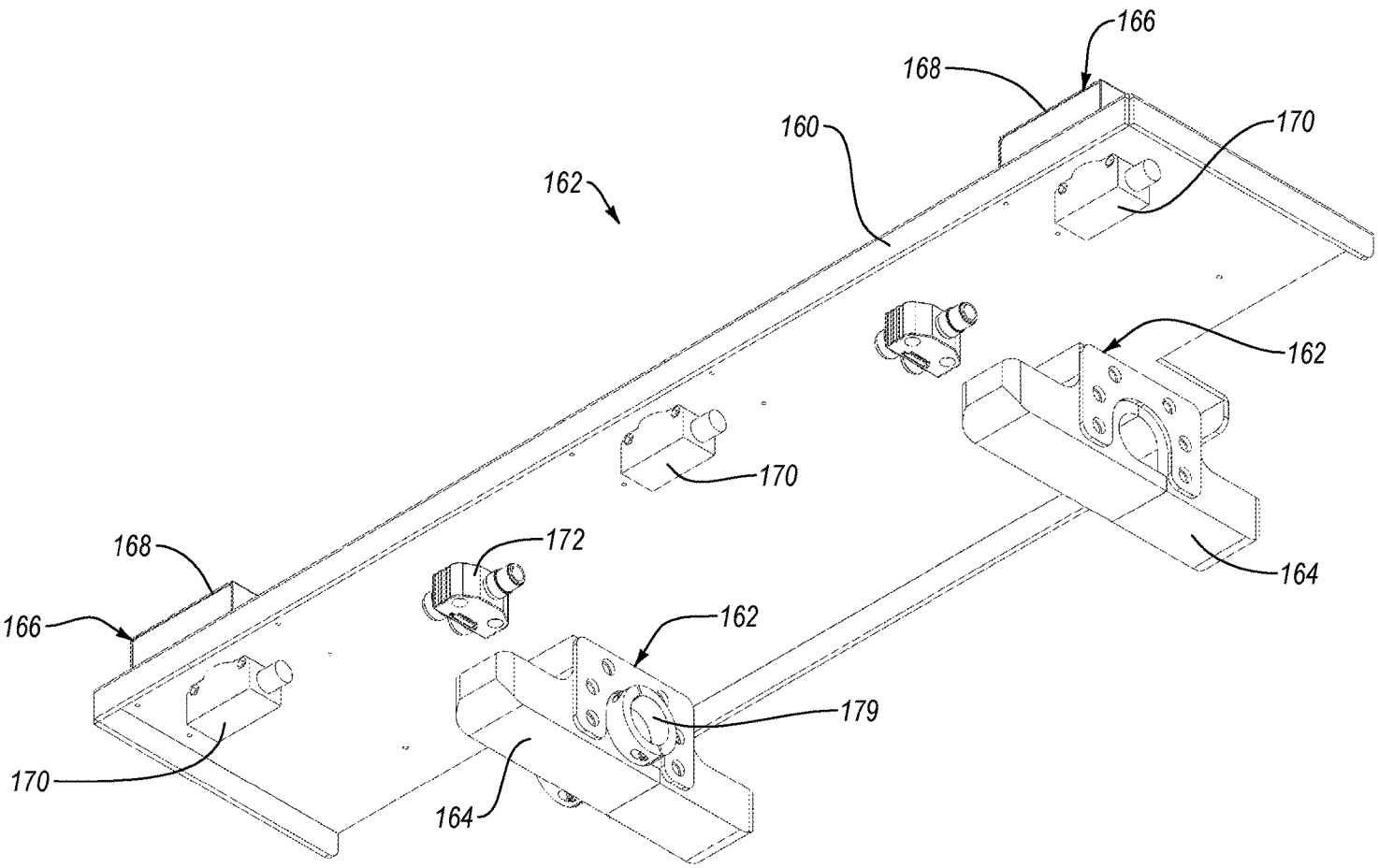
FIG. 10 is a perspective view of a lower assembly of a through-beam sensor system of a scissor lift, showing a bottom of the lower assembly, according to one or more examples of the present disclosure.
Figure 11:
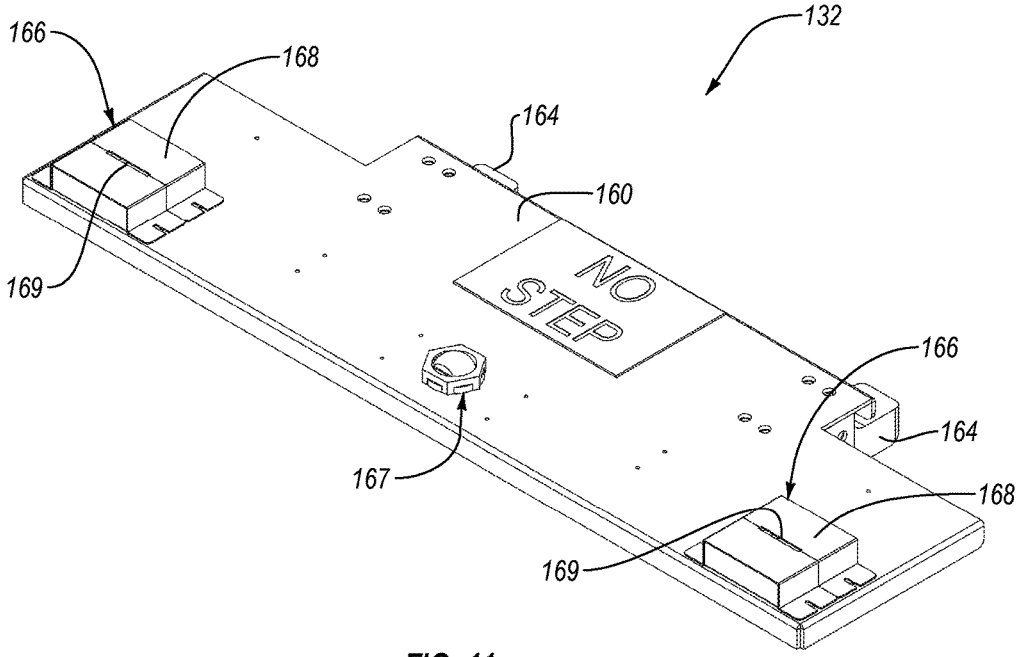
FIG. 11 is a perspective view of the lower assembly of the through-beam sensor system of FIG. 10, showing a top of the lower assembly, according to one or more examples of the present disclosure.
Figure 12:
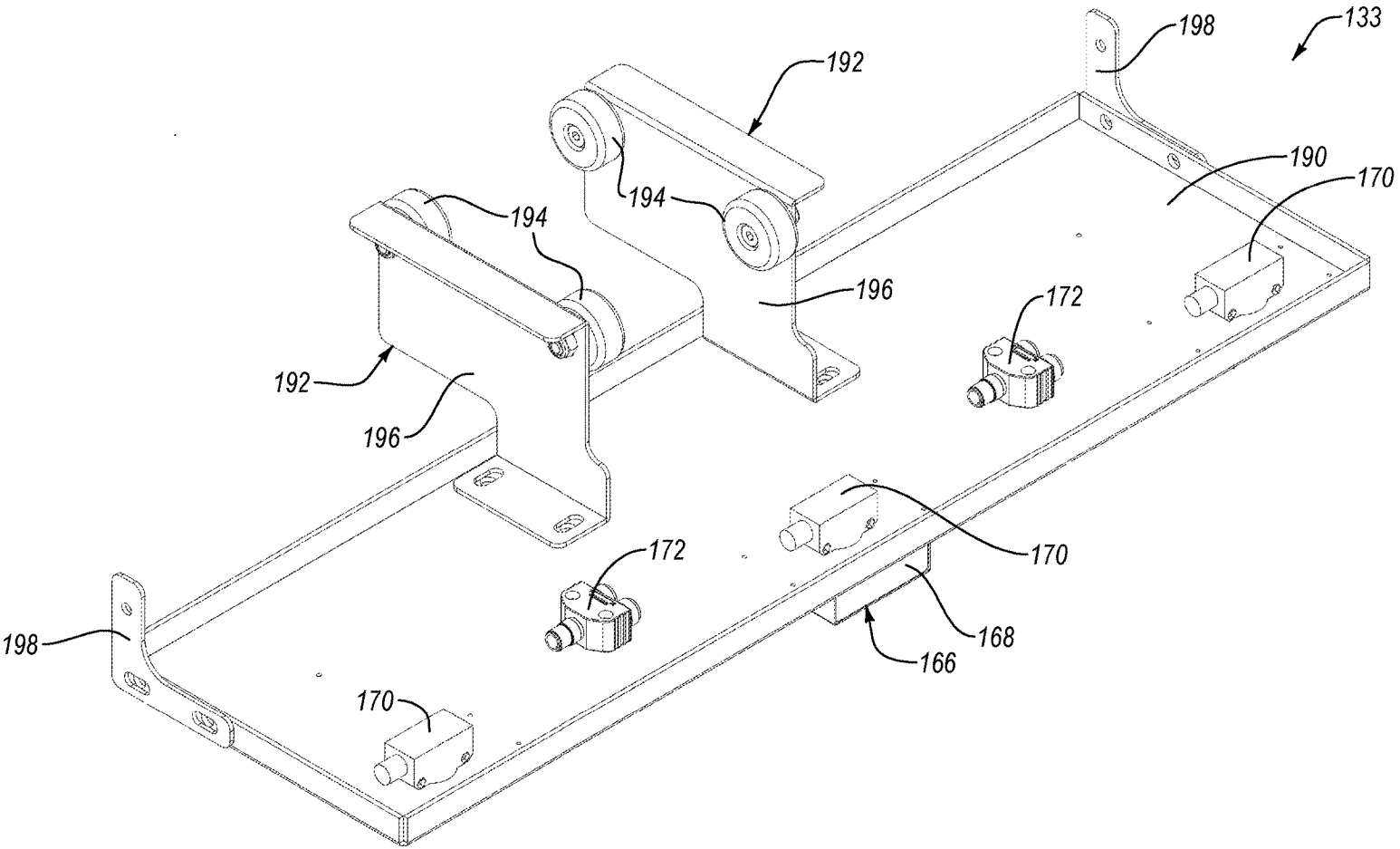
FIG. 12 is a perspective view of an upper assembly of a through-beam sensor system of a scissor lift, showing a bottom of the upper assembly, according to one or more examples of the present disclosure.

In the illustrated embodiment, as shown in FIGS. 10-12 the through-beam sensor sub-system 130 includes three pairs of emitters 167 and receivers 166. Each pair is laterally spaced apart from each other to expand the coverage area of the continuous beam. In one implementation, one emitter 167 and two receivers 166 are mounted on the lower platform 160 of the lower assembly 132, and two emitters 167 and one receiver 166 are mounted on the upper platform 190 of the upper assembly 133. According to another implementation, one emitter 167 and two receivers 166 are mounted on the upper platform 190 of the upper assembly 133, and two emitters 167 and one receiver 166 are mounted on the lower platform 160 of the lower assembly 132. The emitter and receivers on one platform are staggered, such that the emitter is between the receivers, and the emitters and receiver on the other platform are staggered, such that the receiver is between the emitters. In other embodiments, the through-beam sensor sub-system 130 includes fewer or more than three pairs of emitters 167 and receivers 166. The multiple beams generated by the emitters 167 collectively define the beam 134.

Referring again to FIGS. 10-12, in some embodiments, each receiver 166 includes a photoelectric sensor enclosed within a covering or shield 168. The shield 168 is mounted onto the lower platform 160 or upper platform 190 over the photoelectric sensor (not shown). In some implementations, the shield 168 is made of a metal. The shield 168 includes an opening or slit 169 (see, e.g., FIG. 11) that allows a limited amount of the continuous beam of the corresponding emitter 167 to be detected by the photoelectric sensor enclosed within the shield 168. The slit 169 is aligned with the corresponding emitter 167. In this manner, noise from environmental light and signal sources are less detectable by the photoelectric sensor, which helps reduce false readings taken by the photoelectric sensor. In other words, the shield 168 and the slit 169 help to allow only the beam generated by a corresponding emitter 167 to pass through and be detected by the photoelectric sensor of the receiver 166.

Each receiver 166 and emitter 167 also includes a control module 170 mounted on an opposite side of the platforms from the photoelectric sensor of each receiver 166 and photoelectric beam generator of each emitter 167. The control module 170 receives and transmits electrical signals from and to one or more signal splitters 172 also mounted to the platforms.

As shown in FIGS. 10 and 11, the lower assembly 132 further includes two sled assemblies 162 mounted to the lower platform 160. The sled assemblies 162 are spaced apart from each other on the lower platform 160. Each sled assembly 162 includes an engagement element, such as sled 164 (or shoes), fixed to a lower surface of the lower platform 160 by a bracket in some implementations. Each sled 164 has a relatively flat, smooth engagement surface. The sled assemblies 162 additionally include an aperture, which passes through the sleds 164 in some implementations. At least one of the sled assemblies 162 additionally includes a collar 179 positioned within the aperture of the respective sled assembly 162. Although each sled assembly 162 includes a sled 164, in alternative implementations, each sled assembly 162 may include other non-rotatable elements or rotatable elements, such as casters, wheels, rollers, belts, and the like, instead of a sled 164.

Referring now to FIG. 12, the upper assembly 133 further includes two caster assemblies 192 mounted to the upper platform 190. The caster assemblies 192 are spaced apart from each other on the upper platform 190. Each caster assembly 192 includes a bracket 196 fixed to an upper surface of the upper platform 190. Rotatably attached to each bracket 196 are engagement elements, such as casters 194. The casters 194 are spaced apart from each other in the third direction 264 and the fourth direction 266. In alternative implementations, the casters 194 can be replaced with other rotatable elements, such as wheels, rollers, belts, etc., or non-rotatable elements, such as a sled.

The scissor extension mechanism 54 has a basket-end portion 56 and a base-end portion 61. The basket-end portion 56 is the section/end of the scissor extension mechanism 54 that is coupled to the passenger basket 52 and the base-end portion 61 is the section/end of the scissor extension mechanism 54 that is coupled to the base 58 of the scissor lift 50. As mentioned above, the upper assembly 133 is mounted to the basket-end portion 56 of the scissor extension mechanism 54, while the lower assembly 132 is mounted to the base-end portion 61 of the scissor extension mechanism 54. Although the upper assembly 133 and the lower assembly 132 are mounted to the front of the scissor lift 50 to detect obstructions when moving forward, in other embodiments, additional assemblies similar to the upper assembly 133 and the lower assembly 132 can be mounted to the back or sides of the scissor lift 50 to detect obstructions when moving to the side or backward.

Also, in alternative embodiments, the configuration of the scissor extension mechanism 54 can be reversed such that the front lateral supports 55 can be non-movably fixed relative to the passenger basket 52 and the base 58, and the rear lateral supports 57 can move in the third direction 264 and the fourth direction 266 to raise and lower the passenger basket 52. In such embodiments, the upper assembly 133 and the lower assembly 132 can instead be co-movably fixed to the rear lateral supports 57 such that the beam 134 remains adjacent the rearwardmost extent of the scissor extension mechanism 54 such that the rearwardmost extent of the scissor extension mechanism 54 is between the forwardmost extent of the scissor extension mechanism 54 and the beam 134.

FIG. 4 is a side view of the scissor lift 50 showing one embodiment of the collision avoidance system 53, and specifically showing additional details of the through-beam sensor sub-system 130. A representation of the beam 134 maintained between the corresponding set 132 of emitter and receiver is shown as a dashed line in FIGS. 4, 8, and 9.

FIG. 4 also depicts various lateral supports 55, 57 of the scissor extension mechanism 54. The lateral supports 55 can be considered front lateral supports and the lateral supports 57 can be considered rear lateral supports. The lateral supports 55, 57 define nodes or pivot points about which the ends of the support members 139 pivot when the scissor extension mechanism 54 raises and lowers the passenger basket 52 relative to the base 58. The support members 139 are also connected and pivot relative to each other at midpoints of the support members 139. The front lateral supports 55 effectively define the forward extent of the scissor extension mechanism 54.

As shown in FIGS. 8 and 9, because the front lateral supports 55 all move in the third direction 264 as the passenger basket 52 is raised, the forward extent of the scissor extension mechanism 54 also moves in the third direction 264. In contrast, because the front lateral supports 55 all move in the fourth direction 266 as the passenger basket 52 is lowered, the forward extent of the scissor extension mechanism 54 also moves in the fourth direction 266. Accordingly, the lower assembly 132 and the upper assembly 133 are arranged such that the beam 134 remains just forward of the forward extent of the scissor extension mechanism 54. In some implementations, the rearwardmost extent of the scissor extension mechanism 54, effectively defined by the rear lateral supports 57, is constrained from movement in the third direction 264 and the fourth direction 266 relative to passenger basket 52 and the base 58. In other words, the uppermost and lowermost rear lateral supports 57 can be non-movably fixed relative to the passenger basket 52 and the base 58, respectively. However, in other implementations, the rearwardmost extent of the scissor extension mechanism 54 is not fixed relative to the passenger basket 52 and the base 58, but moves in the third direction 264 as the forwardmost extent of the scissor extension mechanism 54 moves in the fourth direction 266, and moves in the fourth direction 266 as the forwardmost extent of the scissor extension mechanism 54 moves in the third direction 264 to respectively lower and raise the passenger basket 52.

Moreover, because the lower assembly 132 is co-movably fixed to a front lateral support 55 at the base-end portion 61 of the scissor extension mechanism 54 and the upper assembly 133 likewise is co-movably fixed to a front lateral support 55 at the basket-end portion 56, the lower assembly 132 and the upper assembly 133 move along with the lateral supports 55. In this manner, the beam(s) 134 remains just forward of the forward extent of the scissor extension mechanism 54 as the passenger basket 52 is raised and lowered by the scissor extension mechanism 54. In other words, the beam 134 remains adjacent the forwardmost extent of the scissor extension mechanism 54 such that the forwardmost extent of the scissor extension mechanism 54 is between the rearwardmost extent of the scissor extension mechanism 54 and the beam 134. In one embodiment, the front lateral support 55 at the base-end portion 61 of the scissor extension mechanism 54 passes through the apertures in the sled assemblies 162 of the lower assembly 132. The collar 179 can be clamped down on the front lateral support 55 at the base-end portion 61 to fix the lower assembly 132 to the front lateral support 55 at the base-end portion 61.

Although not shown, the upper assembly 133 can be similarly fixed to the front lateral support 55 at the basket-end portion 56. For example, the upper assembly 133 may further include scissor extension brackets 198 mounted to the upper platform 190. The scissor extension brackets 198 in turn are mounted to a movable portion of the basket-end portion 56 of the scissor extension mechanism 54 using any of various couplers, such as fasteners or bolts.

Referring to FIGS. 1-4, 8, and 9, the base 58 of the scissor lift 50 further includes a pair of rails 182 (e.g., lower rails) that are spaced apart from each other. The rails 182 are parallel to each other and to the third and fourth directions 264, 266. When the lower assembly 132 is fixed to the lowermost front lateral support 55, the engagement surface of each sled 164 is engaged (e.g., supported on) a respective one of the rails 182. As the scissor extension mechanism 54 raises and lowers the passenger basket 52, each one of the sleds 164 moves (e.g., slides) along the respective one of the rails 182 to movably support the lower platform 160 relative to the rails 182.

Like the base 58, the passenger basket 52 of the scissor lift 50 further includes a pair of rails 184 (e.g., upper rails) that are spaced apart from each other. The rails 184 are parallel to each other and to the third and fourth directions 264, 266. When the upper assembly 133 is fixed to the uppermost front lateral support 55, the casters 194 of each caster assembly 192 are engaged (e.g., supported on) a respective one of the rails 184. As the scissor extension mechanism 54 raises and lowers the passenger basket 52, the casters 194 move (e.g., roll) along the respective one of the rails 184 to movably support the upper platform 190 relative to the rails 184. With the casters 194 supported on the rails 184, the upper platform 190 effectively hangs below the rails 184 via the brackets 196.

As briefly mentioned above, each corresponding set of emitter 167 and receiver 166 is mounted to and moves with the basket-end portion 56 and the base-end portion 57 of the scissor extension mechanism 54. Because the emitters 167 and receivers 166 are mounted to the moving ends of the scissor extension mechanism 54, the extension and retraction of the scissor extension mechanism 54, which causes the body of pantographic structure(s) to narrow (during vertical extension) and widen (during vertical retraction), also causes the mounted emitters and receivers to move correspondingly (in the horizontally narrowing and widening directions). In other words, the beam 134 between an emitter 167 and receiver 166 is maintained just beyond the front lateral supports 55 of the scissor extension mechanism 54 to prevent the scissor extension mechanism 54 itself from registering as an obstruction by interrupting the beam 134.

FIG. 4 also depicts an extendable platform 51. In certain embodiments and in certain applications, the scissor lift 50 includes an extendable platform 51 that can extend out from the passenger basket 52 to allow operators/passengers greater positioning flexibility. In such embodiments, the platform 51 may also be configured to have additional proximity sensor elements 112 and/or impact sensor elements embedded in additional padding mounted to the platform.

Figure 5A:
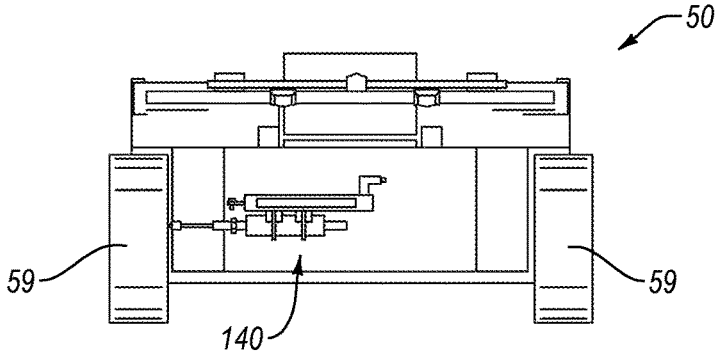
FIG. 5A is a front view of a wheeled-base of a scissor lift, specifically showing details of a wheel position transducer in a straight position, according to one or more examples of the present disclosure.
Figure 5B:
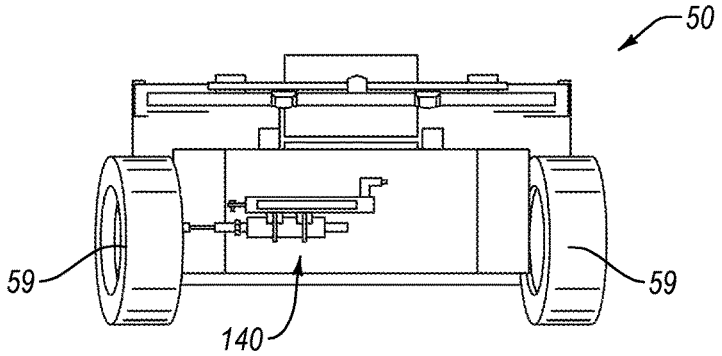
FIG. 5B is a front view of a wheeled-base of a scissor lift, specifically showing details of a wheel position transducer in a turned position, according to one or more examples of the present disclosure.
Figure 5C:
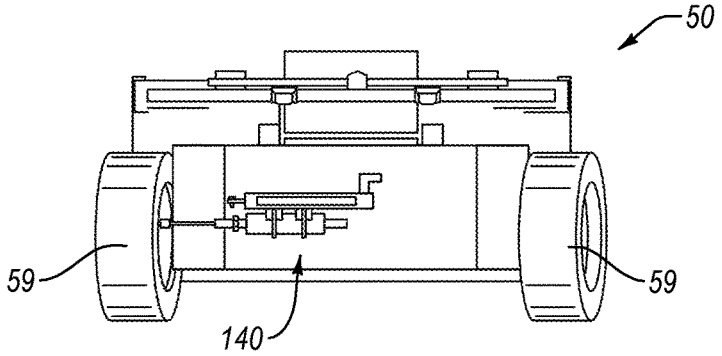
FIG. 5C is a front view of a wheeled-base of a scissor lift, specifically showing details of a wheel position transducer in another turned position, according to one or more examples of the present disclosure.

FIGS. 5A-5C are front views of a wheeled-base 58 of a scissor lift 50, specifically showing details of a wheel position transducer 140. In FIG. 5A, the wheels 59 of the base 58 are substantially straight, in FIG. 5B the wheels 59 of the base 58 are turned in a first direction, and in FIG. 5C the wheels 59 of the base 58 are turned in a second direction. The wheel position transducer 140 is configured to detect the wheel position and alert the operator, thereby making it easier for the operator/driver to move the lift 50 with confidence that he/she will not inadvertently run into an object. In other words, the operator does not have to try and remember, upon parking the lift 50, in which direction the wheels are oriented. The wheel position transducer 140 will detect such a position and report it back to the operator. In one embodiment, the wheel position transducer 140 only monitors a single wheel. In another embodiment, the wheel position transducer 140 monitors the positions of all the wheels (at least all of the "turnable" wheels). For example, the base 58 of a scissor lift 50 may have four wheels that can be independently positioned and the wheel position transducer 140, or at least several different wheel position transducers, can detect and account for the wheel position of all of the wheels.

Figure 5D:
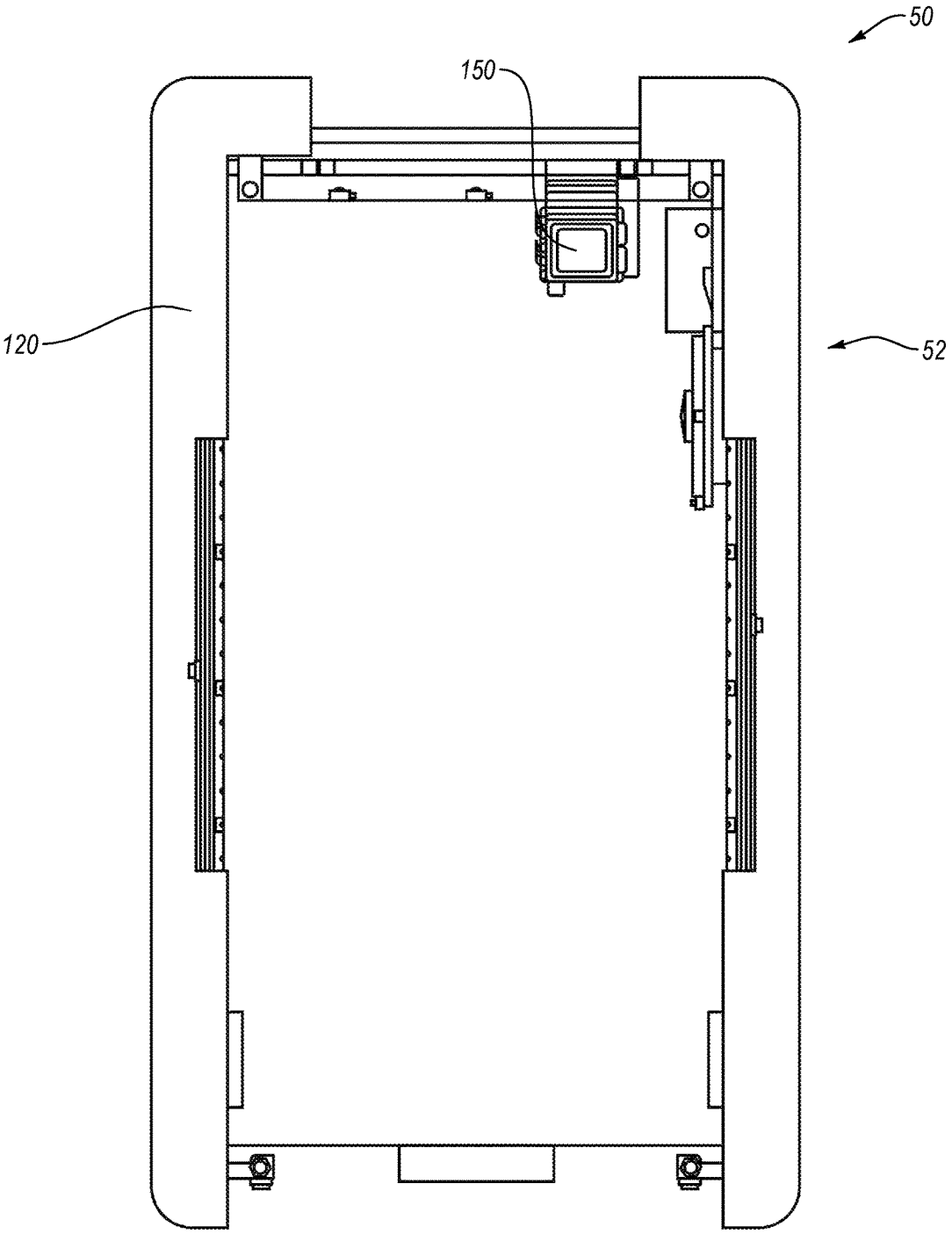
FIG. 5D is a top view of the scissor lift with a display unit for displaying operation and collision conditions, according to one or more examples of the present disclosure.

FIG. 5D is a top view of the scissor lift showing one embodiment of a display unit 150 for displaying operation and collision conditions. The display unit 150 may be a screen or monitor that displays various conditions and reports pertaining to the position and status of the lift 50. In one embodiment, the display unit is implemented in conjunction with the user control interface for operating/driving the lift 50. In one embodiment, the display unit 150 includes schematic depictions of the lift 50 that convey the collision status of the lift 50. For example, in one embodiment, the display unit 150 can display highlighted areas of the schematic depiction of the lift 50 that are close to a structure (i.e., within the warning threshold). In other words, the warning indicator may be a highlighted area on the display unit 150 or a flashing/beeping signal emanating from the display unit 150.

In another embodiment, the display unit 150 may display the angle/position of the wheels, thereby allowing an operator to properly orient the wheels before driving the lift 50 to a new location alongside the structure 60. The display unit 150, in conjunction with the user control interface, may include buttons, switches, levers, joysticks, a steering wheel, a throttle, a touch-screen, a keypad, a keyboard, numberpads, etc. The display unit 150 may be mounted to the lift 50 in various positions, according to the specifics of a given application and/or according to the preferences of a specific operator.

Figure 6A:
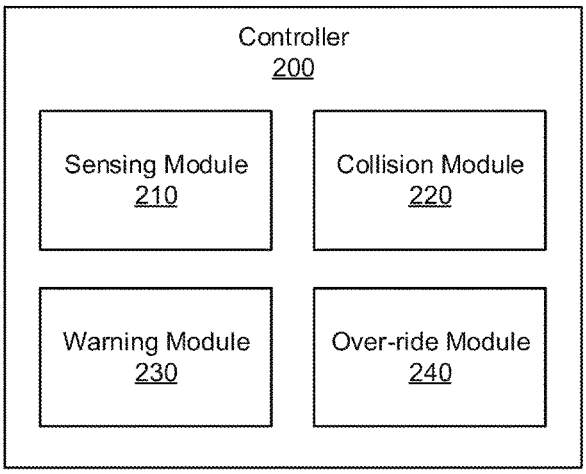
FIG. 6A is schematic block diagram of a controller for avoiding scissor lift collisions, according to one or more examples of the present disclosure.

FIG. 6A is a schematic block diagram of one embodiment of a controller 200 for avoiding scissor lift collisions. The controller 200 includes a sensing module 210, a collision module 220, a warning module 230, and an over-ride module 240. The sensing module 210 receives conditions and reports from the various sensor sub-systems. Once the conditions are received from the sensors, the collision module 220 determines a collision status for the scissor lift 50. Based on the collision status, the warning module 230 and the over-ride module 240 will determine whether/when to active a warning indicator or an over-ride/shut-off command, respectively. These modules are described in greater detail below with reference to FIG. 6B.

Figure 6B:
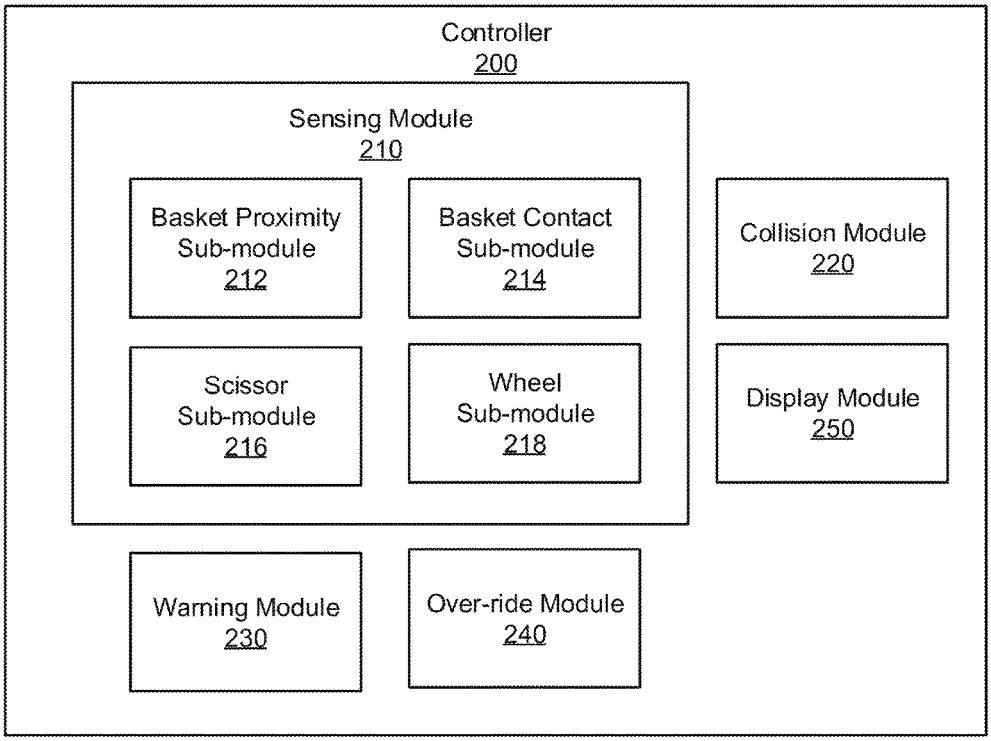
FIG. 6B is a schematic block diagram of another controller for avoiding scissor lift collisions, according to one or more examples of the present disclosure.

FIG. 6B is a schematic block diagram of another embodiment of the controller 200 for avoiding scissor lift collisions. The controller includes the modules 210, 220, 230, 240 described above, but also shows various sub-modules of the sensing module 210 and a display module 250. The various sub-modules include a basket proximity sub-module 212, a basket contact sub-module 214, a scissor sub-module 216, and a wheel sub-module 218. The basket proximity sub-module 212 detects the spatial proximity of the passenger basket to surrounding objects/structures. The detected spatial proximity may be the shortest distance detected between one face of the passenger basket 52 and a surrounding object/structure. In another embodiment, the spatial proximity detected by the basket proximity sub-module 212 may include a collection of distances, representing a mapping of the objects/structures surrounding the passenger basket 52.

The basket contact sub-module 214 detects an impact condition of the passenger basket with the surrounding objects. For example, the impact condition may simply be a notification that the passenger basket 52 has impacted a surrounding object/structure. In another embodiment, as briefly described above, the impact condition may include the direction and magnitude of the impact.

The scissor sub-module 216 detects an obstruction condition of the scissor extension mechanism with the surrounding objects. The obstruction condition is an indication that the through-beam 134 has been interrupted and that there is an obstruction in the scissor extension mechanism 54. In one embodiment, depending on the number of corresponding sets of emitters and receivers and the distance between adjacent emitters and receivers in the sensor banks, the obstruction condition may further include general dimensions for the obstruction that interrupted the through-beam. The wheel sub-module 218 detects a wheel position of at least one of the wheels 59 of the base 58.

As described above, the collision module 220, according to one embodiment, receives the spatial proximity, the impact condition, the obstruction condition, and the wheel position from the sensing module 210. The collision module 220 then determines a collision status that is based on the various conditions and positions received from the sensing module 210. In one embodiment, the collision status may be an "all-clear" signal, with no impending/detected potential collisions. In another embodiment, the collision status may be a number that represents the distance between the lift 50 and the nearest surrounding object/structure. In yet another embodiment, the collision status may merely be a notification that an obstruction has been detected in the scissor extension mechanism 54. Further, the collision status may be any of the above. In other words, the collision status may be any number, report, or rating that represents the collision situation.

Regardless of whether the collision status, determined from the sensed/detected conditions, is a number, a rating, or a report, the warning module 230 determines if the collision status is within a predetermined warning threshold. If the collision status is within the predetermined warning threshold, the warning module 230 activates a warning indicator to alert/advise the operator accordingly. For example, in one embodiment, the collision status may indicate a distance between the passenger basket 52 and the nearest surrounding object. If that distance is within the predetermined warning threshold, the warning module 230 may activate an audible or visible alarm (i.e., a sound, a light, etc.). For example, for a certain application the warning module 230 may have a warning threshold of 5 feet. If the distance indicated in the collision status is 5 feet or less, a warning indicator is activated.

In one embodiment, the warning module 230 has various warning thresholds with corresponding warning indicators. In other words, if the passenger basket 52 is within a first threshold distance from an object, a first warning indicator may be activated. If the passenger basket 52 continues to move closer to the object (or the object moves closer to the passenger basket 52) so that the basket 52 is within a second threshold distance from the object, a second warning indicator may be activated, alerting the operator of the approaching object.

Similar to the warning module 230, if the collision status is within the over-ride threshold of the over-ride module 240, the over-ride module 240 may limit or halt the operator's control over the lift 50, at least temporarily, to prevent damage to the lift 50 and/or the structure/object that is being repaired and inspected. For example, a collision detected by the basket contact sensor sub-system 120 may generate a collision status that falls within the over-ride threshold and the operator may have limited control over the lift's movement. Thus, the operator may only be able to move the lift in a direction away from the imminent or existing collision in order to prevent or decrease collision damage. In another embodiment, an interruption of the through-beam 134 also causes an over-ride action.

The display module 250 is configured to display various conditions, reports, statuses, etc., to an operator of the lift. In one embodiment, as briefly described above with reference to the display unit 150, the display module may display one or more of the following: the spatial proximity, the impact condition, the obstruction condition, the wheel position, the collision status, the warning indicator, the warning threshold, and the over-ride threshold. For example, the display module 250 may display a schematic depiction of the various conditions and positions of the components of the lift 50. In other words, the display module 250 may highlight an area of the schematic depiction of the lift 50 that is close to a structure (i.e., within the warning threshold). In another embodiment, the display module 250 may display the angle/position of the wheels, thereby allowing an operator to properly orient the wheels before driving the lift 50 to a new location alongside the structure 60.

Figure 7:
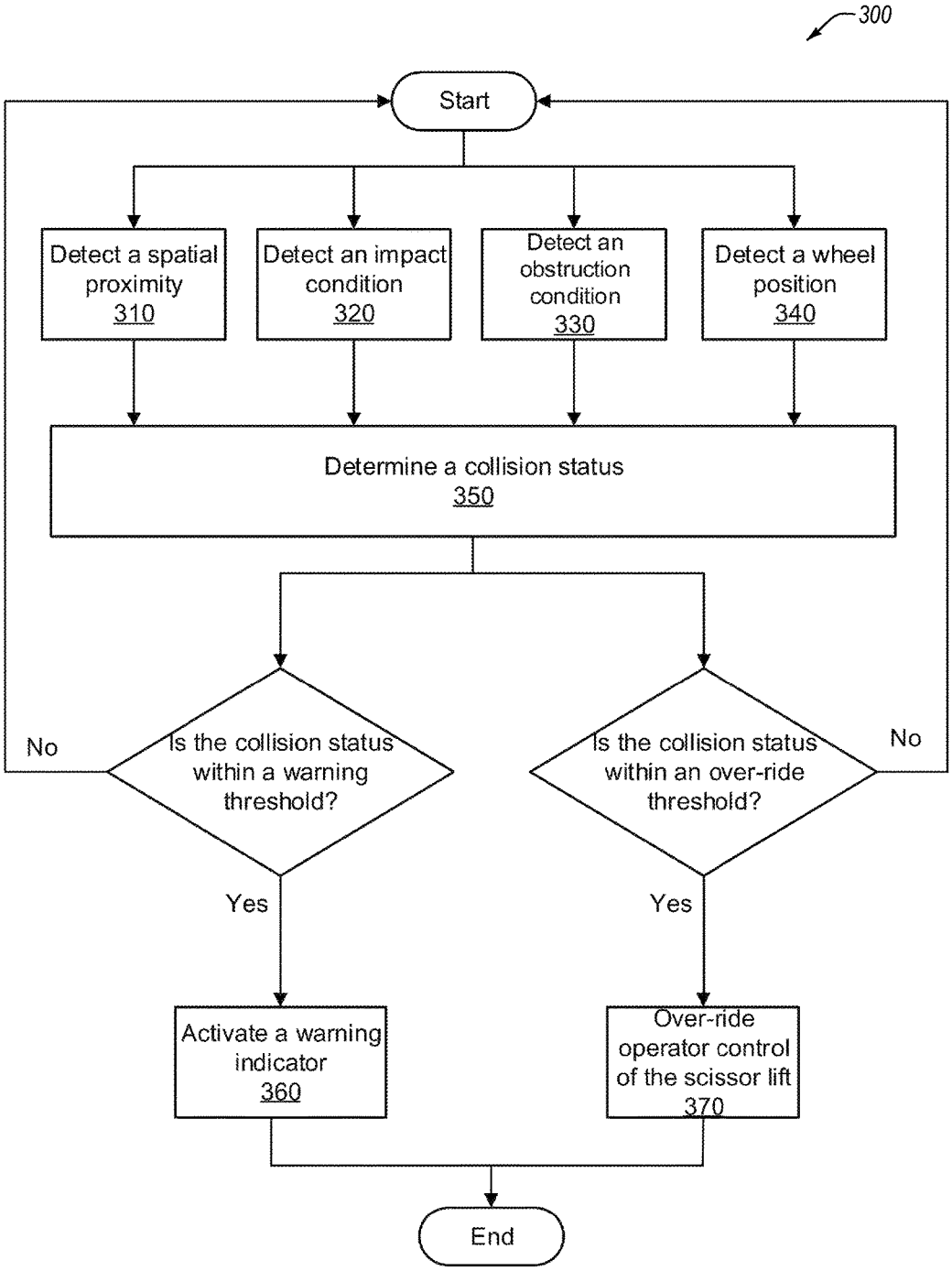
FIG. 7 is a schematic flowchart diagram of a method for avoiding scissor lift collisions, according to one or more examples of the present disclosure.

FIG. 7 is a schematic flowchart diagram of one embodiment of a method 300 for avoiding scissor lift collisions. The method 300 includes at least one of detecting the spatial proximity of the passenger basket to surrounding objects/structures at 310, detecting an impact condition of the passenger basket with the surrounding objects at 320, detecting an obstruction condition of the scissor extension mechanism with the surrounding objects at 330, and detecting a wheel position of at least one of the wheels 59 of the base 58 at 340. The method 300 determines a collision status based on at least one of the spatial proximity, the impact condition, the obstruction condition, and the wheel position at 350. The method 300 further includes determining whether the collision status is within a predetermined warning threshold and activating a warning indicator accordingly at 360. The method 300 also includes determining whether the collision status is within a predetermined over-ride threshold at 370.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of computer readable program code may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of computer readable program code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network. Where a module or portions of a module are implemented in software, the computer readable program code may be stored and/or propagated on in one or more computer readable medium(s).

The computer readable medium may be a tangible computer readable storage medium storing the computer readable program code. The computer readable storage medium may be, for example, but not limited to, an electronic, magnetic, optical, electromagnetic, infrared, holographic, micromechanical, or semiconductor system, apparatus, or device, or any suitable combination of the foregoing.

More specific examples of the computer readable medium may include but are not limited to a portable computer diskette, a hard disk, a random access memory (RAM), a read-only memory (ROM), an erasable programmable read-only memory (EPROM or Flash memory), a portable compact disc read-only memory (CD-ROM), a digital versatile disc (DVD), an optical storage device, a magnetic storage device, a holographic storage medium, a micromechanical storage device, or any suitable combination of the foregoing. In the context of this document, a computer readable storage medium may be any tangible medium that can contain, and/or store computer readable program code for use by and/or in connection with an instruction execution system, apparatus, or device.

The computer readable medium may also be a computer readable signal medium. A computer readable signal medium may include a propagated data signal with computer readable program code embodied therein, for example, in baseband or as part of a carrier wave. Such a propagated signal may take any of a variety of forms, including, but not limited to, electrical, electro-magnetic, magnetic, optical, or any suitable combination thereof. A computer readable signal medium may be any computer readable medium that is not a computer readable storage medium and that can communicate, propagate, or transport computer readable program code for use by or in connection with an instruction execution system, apparatus, or device. Computer readable program code embodied on a computer readable signal medium may be transmitted using any appropriate medium, including but not limited to wireless, wireline, optical fiber cable, Radio Frequency (RF), or the like, or any suitable combination of the foregoing.

In one embodiment, the computer readable medium may comprise a combination of one or more computer readable storage mediums and one or more computer readable signal mediums. For example, computer readable program code may be both propagated as an electro-magnetic signal through a fiber optic cable for execution by a processor and stored on RAM storage device for execution by the processor.

Computer readable program code for carrying out operations for aspects of the present invention may be written in any combination of one or more programming languages, including an object oriented programming language such as Java, Smalltalk, C++ or the like and conventional procedural programming languages, such as the "C" programming language or similar programming languages (e.g., LabVIEW). The computer readable program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The present subject matter may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. A scissor lift, comprising:

a passenger basket;

a base, comprising wheels;

a scissor extension mechanism between the passenger basket and the base, the scissor extension mechanism being configured to raise the passenger basket in a first direction relative to the base and lower the passenger basket in a second direction, opposite the first direction, relative to the base; and a through-beam sensor system co-movably coupled to the scissor extension mechanism, wherein the through-beam sensor system moves in a third direction, perpendicular to the first direction and the second direction, when the scissor extension mechanism raises the passenger basket and moves in a fourth direction, opposite the third direction, when the scissor extension mechanism lowers the passenger basket.

2. The scissor lift according to claim 1, wherein the through-beam sensor system comprises:

a lower assembly constrained from movement in the first direction and the second direction relative to the base;

an upper assembly constrained from movement in the first direction and the second direction relative to the passenger basket; and the lower assembly is spaced-apart from the upper assembly.

3. The scissor lift according to claim 2, wherein the lower assembly comprises one of a first emitter, configured to emit a first beam, or a first receiver;

when the lower assembly comprises the first emitter, the upper assembly comprises a second receiver configured to receive the first beam from the first emitter;

when the lower assembly comprises the first receiver, the upper assembly comprises a second emitter configured to emit a second beam;

the first receiver is configured to receive the second beam from the second emitter;

the first beam and the second beam move in the third direction when the scissor extension mechanism raises the passenger basket; and the first beam and the second beam move in the fourth direction when the scissor extension mechanism lowers the passenger basket.

4. The scissor lift according to claim 3, wherein:

the scissor extension mechanism comprises a plurality of legs pivotably coupled together at first pivot nodes and second pivot nodes;

the first pivot nodes define a rearwardmost extent of the scissor extension mechanism;

the second pivot nodes define a forwardmost extent of the scissor extension mechanism; and the first beam and the second beam are adjacent the forwardmost extent of the scissor extension mechanism such that the forwardmost extent of the scissor extension mechanism is between the rearwardmost extent of the scissor extension mechanism and the first beam and second beam.

5. The scissor lift according to claim 4, wherein:

the rearwardmost extent of the scissor extension mechanism is constrained from movement in the third direction and the fourth direction; and the forwardmost extent of the scissor extension mechanism moves in the third direction when the scissor extension mechanism raises the passenger basket and moves in the fourth direction when the scissor extension mechanism lowers the passenger basket.

6. The scissor lift according to claim 3, wherein:

each of the first receiver and the second receiver comprises a sensor enclosed within a shield comprising a slit;

the first beam is sensed by the sensor of the first receiver after passing through the slit of the shield of the first receiver; and the second beam is sensed by the sensor of the second receiver after passing through the slit of the shield of the second receiver.

7. The scissor lift according to claim 3, wherein:

the lower assembly comprises both the first emitter and the first receiver; and the upper assembly comprises both the second emitter and the second receiver.

8. The scissor lift according to claim 7, wherein:

the lower assembly further comprises one of:

another first receiver, wherein the first emitter is between the first receivers; or another first emitter, wherein the first receiver is between the first emitters;

when the lower assembly comprises another first receiver, the upper assembly further comprises another second emitter, wherein the second receiver is between the second emitters; and when the lower assembly comprises another first emitter, the upper assembly further comprises another second receiver, wherein the second emitter is between the second receivers.

9. The scissor lift according to claim 3, wherein:

the base of the scissor lift comprises at least one lower rail parallel to the third direction and the fourth direction;

the lower assembly further comprises:

a lower platform to which the one of the first emitter or the first receiver is mounted; and at least one first engagement element mounted to the lower platform and movably engageable with the at least one lower rail.

10. The scissor lift according to claim 9, wherein the engagement element comprises a sled that is slidably engageable with the at least one lower rail.

11. The scissor lift according to claim 3, wherein:

the basket of the scissor lift comprises at least one upper rail parallel to the third direction and the fourth direction;

the upper assembly further comprises:

an upper platform to which the one of the second emitter or the second receiver is mounted; and at least one second engagement element mounted to the upper platform and movably engageable with the at least one upper rail.

12. The scissor lift according to claim 11, wherein the second engagement element comprises at least one caster.

13. A scissor lift, comprising:

a passenger basket, comprising:

a rail;

at least one padded bumper coupled to the rail, wherein the padded bumper comprises:

a foam core made of a soft, pliable foam; and at least one impact sensor element, comprising an array of impact sensors, embedded within the foam core;

a base, comprising wheels; and a scissor extension mechanism between the passenger basket and the base, the scissor extension mechanism being configured to raise and lower the passenger basket relative to the base.

14. The scissor lift according to claim 13, wherein the padded bumper comprises a weatherproof cover enveloping the foam core.

15. The scissor lift according to claim 13, wherein the foam core has a thickness of at least 10.16 centimeters.

16. The scissor lift according to claim 13, wherein:

the rail extends about an entire upper periphery of the passenger basket; and the padded bumper extends about only a portion of the upper periphery of the passenger basket such that the passenger basket comprises a non-padded portion along the upper periphery of the passenger basket.

17. The scissor lift according to claim 13, wherein the at least one impact sensor element extends lengthwise along an entire length of the padded bumper.

18. The scissor lift according to claim 13, wherein:

the padded bumper comprises at least two impact sensor elements embedded within the foam core; and the at least two impact sensor elements face orthogonal directions relative to each other.

19. The scissor lift according to claim 13, further comprising at least two padded bumpers, wherein:

the at least two padded bumpers are lengthwise orthogonal to each other; and the at least one impact sensor elements of the at least two padded bumpers are lengthwise orthogonal to each other.

20. The scissor lift according to claim 13, wherein the padded bumper is configured to prevent damage to a part impacted by the padded bumper.

* * * * *